US009251805B2

(12) United States Patent
Aratsu et al.

(10) Patent No.: US 9,251,805 B2
(45) Date of Patent: Feb. 2, 2016

(54) METHOD FOR PROCESSING SPEECH OF PARTICULAR SPEAKER, ELECTRONIC SYSTEM FOR THE SAME, AND PROGRAM FOR ELECTRONIC SYSTEM

(71) Applicant: International Business Machines Corporation, Armonk, NY (US)

(72) Inventors: Taku Aratsu, Tokyo (JP); Masami Tada, Tokyo (JP); Akihiko Takajo, Tokyo (JP); Takahito Tashiro, Tokyo (JP)

(73) Assignee: International Business Machines Corporation, Armonk, NY (US)

( * ) Notice: Subject to any disclaimer, the term of this patent is extended or adjusted under 35 U.S.C. 154(b) by 18 days.

(21) Appl. No.: 14/094,459

(22) Filed: Dec. 2, 2013

(65) Prior Publication Data

US 2014/0172426 A1 Jun. 19, 2014

(30) Foreign Application Priority Data

Dec. 18, 2012 (JP) ..... 2012-275250

(51) Int. Cl.
*G10L 21/0208* (2013.01)

(52) U.S. Cl.
CPC ... *G10L 21/0208* (2013.01); *G10L 2021/02087* (2013.01)

(58) Field of Classification Search
CPC .... G10L 15/22; G10L 15/265; G10L 21/0208
USPC ..... 704/235
See application file for complete search history.

(56) References Cited

U.S. PATENT DOCUMENTS

| | | | | |
|---|---|---|---|---|
| 2005/0267762 | A1* | 12/2005 | Ichikawa et al. | 704/278 |
| 2006/0149547 | A1 | 7/2006 | Miyazaki | |
| 2009/0037171 | A1* | 2/2009 | McFarland et al. | 704/235 |
| 2010/0100376 | A1* | 4/2010 | Harrington | 704/235 |
| 2011/0013075 | A1* | 1/2011 | Kim et al. | 348/370 |
| 2011/0112833 | A1* | 5/2011 | Frankel et al. | 704/235 |
| 2011/0270609 | A1* | 11/2011 | Jones et al. | 704/235 |

(Continued)

FOREIGN PATENT DOCUMENTS

| | | |
|---|---|---|
| JP | 3088625 | 9/2000 |
| JP | 2004-133403 | 4/2004 |
| JP | 2005-215888 | 8/2005 |

(Continued)

OTHER PUBLICATIONS

International Search Report (Partial Translation) dated Dec. 24, 2013 for International Application No. PCT/JP2013/079264, 1 page.

(Continued)

*Primary Examiner* — Susan McFadden
(74) *Attorney, Agent, or Firm* — Stephen J. Walder, Jr.; William Stock

(57) ABSTRACT

An object of the present invention is to process the speech of a particular speaker. The present invention provides a technique for collecting speech, analyzing the collected speech to extract the features of the speech, grouping the speech, or text corresponding to the speech, on the basis of the extracted features, presenting the result of the grouping to a user, and when one or more of the groups is selected by the user, enhancing, or reducing or cancelling the speech of a speaker associated with the selected group.

18 Claims, 21 Drawing Sheets

(56) References Cited

U.S. PATENT DOCUMENTS

| | | | | |
|---|---|---|---|---|
| 2012/0059651 | A1* | 3/2012 | Delgado et al. | 704/235 |
| 2013/0151249 | A1 | 6/2013 | Nakadai et al. | |

FOREIGN PATENT DOCUMENTS

| | | | |
|---|---|---|---|
| JP | 2006-189626 | A | 7/2006 |
| JP | 2007-187748 | | 7/2007 |
| JP | 2008-087140 | | 4/2008 |
| JP | 2008-250066 | A | 10/2008 |
| JP | 4202640 | | 12/2008 |
| JP | 4217275 | | 1/2009 |
| JP | 2012-98483 | | 5/2012 |
| JP | 2013-122695 | A | 6/2013 |

OTHER PUBLICATIONS

International Search Report and Written Opinion (untranslated) dated Dec. 24, 2013 for International Application No. PCT/JP2013/079264, 9 pages.

Makino, Shoji et al., "Blind separation of audio signals", NTT Technical Journal, vol. 15, No. 12, pp. 8-12, Dec. 2003, available from <URL:http://www.tara.tsukuba.ac.jp/~maki/reprint/Makino/sm03jorna18-12.pdf>.

International Preliminary Report on Patentability dated Jun. 23, 2015 for International Application No. PCT/JP2013/079264, Translation provided on Jul. 2, 2015, 8 pages.

* cited by examiner

METHOD FOR PROCESSING SPEECH OF PARTICULAR SPEAKER, ELECTRONIC SYSTEM FOR THE SAME, AND PROGRAM FOR ELECTRONIC SYSTEM

BACKGROUND

The present invention relates to a technique for processing the speech of a particular speaker. Specifically, the present invention relates to a technique for enhancing, reducing, or cancelling the speech of a particular speaker.

In everyday life, people sometimes do not want to hear only the speech of a particular speaker. In the following cases, for example, such filtering of the speech of a particular speaker is desirable:

the voice of a loud person in a public transport, such as a train, a bus, or an airplane;

the voice of a loud person in a hotel, a museum, or an aquarium; and the voice of a person in a loudspeaker car or a campaign car.

An example of a mechanism for cancelling ambient sounds (also referred to as environmental sounds) includes electronic equipment with a noise canceller, such as a headphone or portable music player with a noise canceller. The electronic equipment with a noise canceller collects ambient sounds with a built-in microphone, mixes a signal in opposite phase thereto with an audio signal, and outputs it to reduce the ambient sounds that enter the electronic equipment from the outside.

Other methods for cancelling ambient sounds include a method for blocking sounds with earplugs and a method for cancelling the noise by listening to a large volume of music with a headphone or earphone.

Japanese Unexamined Patent Application Publication No. 2007-187748 discloses a sound selection and processing unit that selectively removes sounds that a user feels uncomfortable from a sound mixture generated around the user. The unit includes sound separation means for separating the sound mixture into sounds from individual sound sources, uncomfortable-feeling detection means for detecting that the user is in an uncomfortable state, and candidate-sound selection and determination means that operates, when it is determined by the uncomfortable-feeling detection means that the user is in an uncomfortable-feeling state, to evaluate the relationship between the separated sounds and estimating a separated sound candidate to be processed on the basis of the evaluation result. The sound selection and processing unit further comprises candidate-sound presentation and identifying means for presenting the estimated separated sound candidate to be processed to the user, receiving the selection, and identifying the selected separated sound. Moreover, the sound selection and processing unit further comprises sound processing means for processing the identified separated sound to reconstruct a sound mixture.

Japanese Unexamined Patent Application Publication No. 2008-87140 discloses a speech recognition robot capable of responding to a speaker in a state in which it faces the speaker all the time and a method for controlling the speech recognition robot.

Japanese Unexamined Patent Application Publication No. 2004-133403 discloses a speech-signal processing unit that extracts effective speech in which conversation is held under an environment in which a plurality of speech signals from a plurality of speech sources are mixedly input.

Japanese Unexamined Patent Application Publication (Translation of PCT Application) No. 10-512686 discloses a speaker adaptive speech recognition system including feature extraction means for converting speech signals from a speaker to a feature-vector dataset.

Japanese Unexamined Patent Application Publication No. 2003-198719 discloses a headset capable of selectively changing the ratio of an external direct sound to a sound transmitted via a communication system to smooth speech communications and speech commands using a short-range wireless communication headset, as well as a communication system using the same.

Japanese Unexamined Patent Application Publication No. 8-163255 discloses speech recognition based on a speaker adaptive system without a burden on a speaker in a telephone-answering system.

Japanese Unexamined Patent Application Publication No. 2012-98483 discloses a speech-data generation unit that includes input means for inputting the speech of a speaker and conversion means for converting the speech input from the input means to text data, and that generates speech data about the speech of the speaker for masking the speech.

Japanese Unexamined Patent Application Publication No. 2005-215888 discloses a display unit for text sentences, such as a character string and a comment for communications and transmissions, capable of conveying the content, feeling, or mood more deeply.

SUMMARY

In everyday life, people sometimes do not want to hear particular speech. Currently, individuals cope with such a case by wearing electronic equipment with a noise canceller or earplugs, or by hearing a large volume of music with a headphone or an earphone, for example.

It is difficult for the electronic equipment with a noise canceller to reduce the speech of only a particular speaker because it reduces sounds (noise) at random. Furthermore, the electronic equipment with a noise canceller sometimes excessively transmits ambient sounds because it does not reduce sounds in the frequency range of human voice. Accordingly, it is difficult to process only the speech of a particular speaker with the electronic equipment with a noise canceller.

Earplugs block all sounds. Furthermore, listening to a large volume of music with a headphone or an earphone causes the user not to hear ambient sounds. This causes the user to miss necessary information for the user, such as an earthquake alarm or an emergency evacuation broadcast, and thus, it is exposes the user to danger depending on the situation.

Accordingly, an object of the present invention is to allow the user to process the speech of a particular speaker easily in terms of operation and visual sense.

Another object of the present invention is to allow the speech of a particular speaker to be smoothly enhanced or reduced/cancelled by providing a user interface that facilitates processing of the speech of a particular speaker.

The illustrative embodiments of the present invention provide mechanisms for collecting speech, analyzing the collected speech to extract the features of the speech, grouping text corresponding to the speech or the speech on the basis of the extracted features, presenting the result of the grouping to a user. When one or more of the groups is selected by the user, the illustrative embodiments further provide mechanisms for enhancing, or reducing or cancelling, the speech of a speaker associated with the selected group. The technique can include a mechanisms for controlling access to services, an electronic system, a program for the electronic system, and a program product for the electronic system, or the like.

A method of one illustrative embodiment of the present invention includes the operations of collecting speech; analyzing the speech to extract the features of the speech; grouping text corresponding to the speech or the speech on the basis of the features; and presenting the result of the grouping to a user. When one or more of the groups is selected by the user, the method further comprises enhancing, or reducing or cancelling, the speech of a speaker associated with the selected group.

In an embodiment of the present invention, the method includes the operations of collecting speech; analyzing the speech to extract the features of the speech; converting the speech to text; grouping the text corresponding to the speech on the basis of the features and presenting the grouped text to a user. When one or more of the groups is selected by the user, the method comprises enhancing, or reducing or cancelling, the speech of a speaker associated with the selected group.

The electronic system of the present invention includes a sound collection mechanism for collecting speech; a feature extraction mechanism for analyzing the speech to extract the features of the speech; a grouping mechanism for grouping the speech, or text corresponding to the speech, on the basis of the features; a presentation mechanism for presenting the result of the grouping to a user; and a speech-signal synthesis mechanism for, when one or more of the groups is selected by the user, enhancing, or reducing or cancelling, the speech of a speaker associated with the selected group.

In an embodiment of the present invention, the electronic system may further include a speech-to-text mechanism for converting the speech to text. In an embodiment of the present invention, the grouping mechanism can group text corresponding to the speech, and the presentation mechanism can display the grouped text in accordance with the grouping.

In an embodiment of the present invention, the electronic system includes a sound collection mechanism for collecting speech; a feature extraction mechanism for analyzing the speech to extract the features of the speech; a speech-to-text mechanism for converting the speech to text; a grouping mechanism for grouping the text corresponding to the speech on the basis of the features; a presentation mechanism for presenting the grouped text to a user; and a speech-signal synthesis mechanism for, when one or more of the groups is selected by the user, enhancing, or reducing or cancelling the speech of a speaker associated with the selected group.

In an embodiment of the present invention, the presentation mechanism can display the grouped text in chronological order.

In an embodiment of the present invention, the presentation mechanism can display text corresponding to the subsequent speech of the speaker associated with the group following the grouped text.

In an embodiment of the present invention, the electronic system may further include a specification mechanism for specifying the direction of the source of the speech or the direction and distance of the speech source. In an embodiment of the present invention, the presentation mechanism can display the grouped text at a position close to the specified direction on a display or at a predetermined position on the display corresponding to the specified direction and distance.

In an embodiment of the present invention, the presentation mechanism can change the display position of the grouped text as the speaker moves.

In an embodiment of the present invention, the presentation mechanism can change a display method for the text on the basis of the volume, pitch, or quality of the speech, or the feature of the speech of a speaker associated with the group.

In an embodiment of the present invention, the presentation mechanism can display the groups in different colors on the basis of the volumes, pitches, or qualities of the speech.

In an embodiment of the present invention, when the speech of the speaker associated with the selected group is enhanced, and thereafter the selected group is selected again by the user, the speech-signal synthesis mechanism can reduce or cancel the speech of the speaker associated with the selected group.

In an embodiment of the present invention, when the speech of the speaker associated with the selected group is reduced or cancelled, and thereafter the selected group is selected again by the user, the speech-signal synthesis mechanism can enhance the speech of the speaker associated with the selected group.

In an embodiment of the present invention, the electronic system may further include a selection mechanism for permitting the user to select part of the grouped text and a separation mechanism for separating the partial text selected by the user as another group.

In an embodiment of the present invention, the feature extraction mechanism can distinguish the feature of the speech of a speaker associated with the other separated group from the feature of the speech of a speaker associated with the original group.

In an embodiment of the present invention, the presentation mechanism can display, in the separated group, text corresponding to the subsequent speech of the speaker associated with the separated group in accordance with the feature of the speech of the speaker associated with the other separated group.

In an embodiment of the present invention, the selection mechanism may permit the user to select at least two of the groups and the electronic system may comprise a combining mechanism for combining the at least two groups selected by the user as one group.

In an embodiment of the present invention, the feature extraction mechanism can combine the speech of speakers associated with the at least two groups as one group and the presentation mechanism can display text corresponding to the speech combined as one group in the combined one group.

In an embodiment of the present invention, the presentation mechanism can group the speech on the basis of the features and display the result of the grouping on a display, and can display an icon indicating the speaker at a position on the display close to the specified direction or a predetermined position on the display corresponding to the specified direction and distance.

In an embodiment of the present invention, the presentation mechanism can display the result of the grouping and text corresponding to the speech of the speaker in the vicinity of the icon indicating the speaker.

In an embodiment of the present invention, the speech-signal synthesis mechanism can output sound waves in opposite phase to the speech of the speaker associated with the selected group, or can reduce or cancel the speech of the speaker associated with the selected group by reproducing synthesis speech in which the speech of the speaker associated with the selected group is reduced or cancelled.

Furthermore, the present invention provides a program for an electronic system that causes the electronic system to executes the operations of a method according to the present invention (including a computer program) and a program product for the electronic system (including a computer program product).

The program for an electronic system for processing the speech of a particular speaker according to an embodiment of the present invention can be stored in a flexible disk, an MO, a CD-ROM, a DVD, a BD, a hard disk, a memory medium connectable to a USB, and any recording medium that the electronic system can read (including a computer-readable recording medium), such as a ROM, an MRAM, or a RAM. The program for an electronic system can be loaded into a recording medium from another data processing system connected via a communication line or can be copied from another recording medium. The program for an electronic system can also be compressed or divided into a plurality of pieces and can be stored in a single or a plurality of recording media. Note that it is of course possible to provide a program product for an electronic system for achieving the present invention in various forms. Examples of the program product for an electronic system can include a storage medium in which the program product for an electronic system is recorded or a transmission medium that transmits the program product for an electronic system.

Note that the outline of the present invention described above does not include all features of the present invention and a combination or sub-combination of these components can also be utilized in one or more embodiments of the present invention.

The present invention can be achieved as hardware, software executed on one or more processors of one or more computing devices, or, a combination of hardware and software. A typical example of implementation using a combination of hardware and software is implementation in an apparatus in which the program for an electronic system is installed. In such a case, by loading the program for an electronic system into the memory of the apparatus and implementing it, the program for an electronic system controls the apparatus and causes the apparatus to implement processes according to the present invention. The program for an electronic system can include sets of instructions that can be expressed by any languages, codes, or notations. Such instructions allow the apparatus to implement a specific function directly or after one of or both 1. converting it to another language, code, or notation and 2. copying it to another medium.

According to an embodiment of the present invention, the speech of a particular speaker can be selectively reduced or cancelled, and thus the user can concentrate on or easily hear the speech of a person that the user wants to hear. This is useful in the following examples:

- In a public transport (for example, a train, a bus, or an airplane) or a public facility (for example, a concert hall or a hospital), the user can concentrate on conversations with a friend or family member by selectively reducing or cancelling the voice of another loud person;
- In a classroom or a hall in a school, for example, the user can concentrate on the lecture by selectively reducing or cancelling the voice of persons other than the teacher or a presenter;
- During recording in minutes, the speech of a speaker can be recorded efficiently by reducing or cancelling conversations or speech other than that of the speaker;
- During a discussion among members of a plurality of tables (that is, groups or people) in a large room, the user can concentrate on a discussion at a table that the user belongs to (that is, the user's group) by reducing or cancelling conversations of persons other than members of the table that the user belongs to;
- The user can be prevented from missing the audible output of an earthquake alarm or an emergency evacuation broadcast by reducing or cancelling speech other than the earthquake alarm or the emergency evacuation broadcast.
- During sports watching, the user can be prevented from missing the speech of a person who comes with the user and/or an on-premises announcement by reducing or cancelling speech other than those of the person who comes with the user and/or the on-premises announcement;
- During viewing television or listening to radio, the user can concentrate on speech from the television or radio by reducing or cancelling the voices of family members; and
- During driving of a campaign car or a loudspeaker car, the user can be prevented from hearing noise due to the voice from the campaign car or the loudspeaker car by reducing or cancelling the voice therefrom.

According to an embodiment of the present invention, the speech of a particular speaker can be selectively enhanced, and thus, the user can concentrate on or easily hear the speech of a person that the user wants to hear. This is useful in the following examples:

- In a public transport or a public facility, the user can concentrate on conversations with a friend or a family member by selectively enhancing the voice of the friend or family member;
- In a classroom or a hall in a school, for example, the user can concentrate on the lecture by selectively enhancing the voice of a teacher or a presenter;
- During recording in minutes, the speech of a speaker can be recorded efficiently by enhancing the speech of the speaker;
- During a discussion among members of a plurality of tables in a large room, the user can concentrate on a discussion at a table that the user belongs to by enhancing conversations of members at the table that the user belongs to;
- The user can be prevented from missing the audible output of an earthquake alarm or an emergency evacuation broadcast by enhancing the speech thereof;
- During sports watching, the user can be prevented from missing the speech of a person who came with the user and/or an on-premises announcement by enhancing the speech thereof;

During viewing television or listening to radio, the user can concentrate on speech from the television or radio by enhancing the speech thereof.

According to an embodiment of the present invention, the user can concentrate on conversations with a particular speaker by combining enhancing the speech of the particular speaker and selectively reducing or cancelling the speech of another particular speaker.

BRIEF DESCRIPTION OF THE SEVERAL VIEWS OF THE DRAWINGS

The invention, as well as a preferred mode of use and further objectives and advantages thereof, will best be understood by reference to the following detailed description of illustrative embodiments when read in conjunction with the accompanying drawings, wherein.

DETAILED DESCRIPTION

Embodiments of the present invention will be described hereinbelow with reference to the drawings. The same reference sign denotes the same object in all of the drawings unless otherwise noted. It should be understood that the embodiments of the present invention are merely for describing preferred forms of the present invention and are not intended to limit the scope of the present invention.

Figure 1:
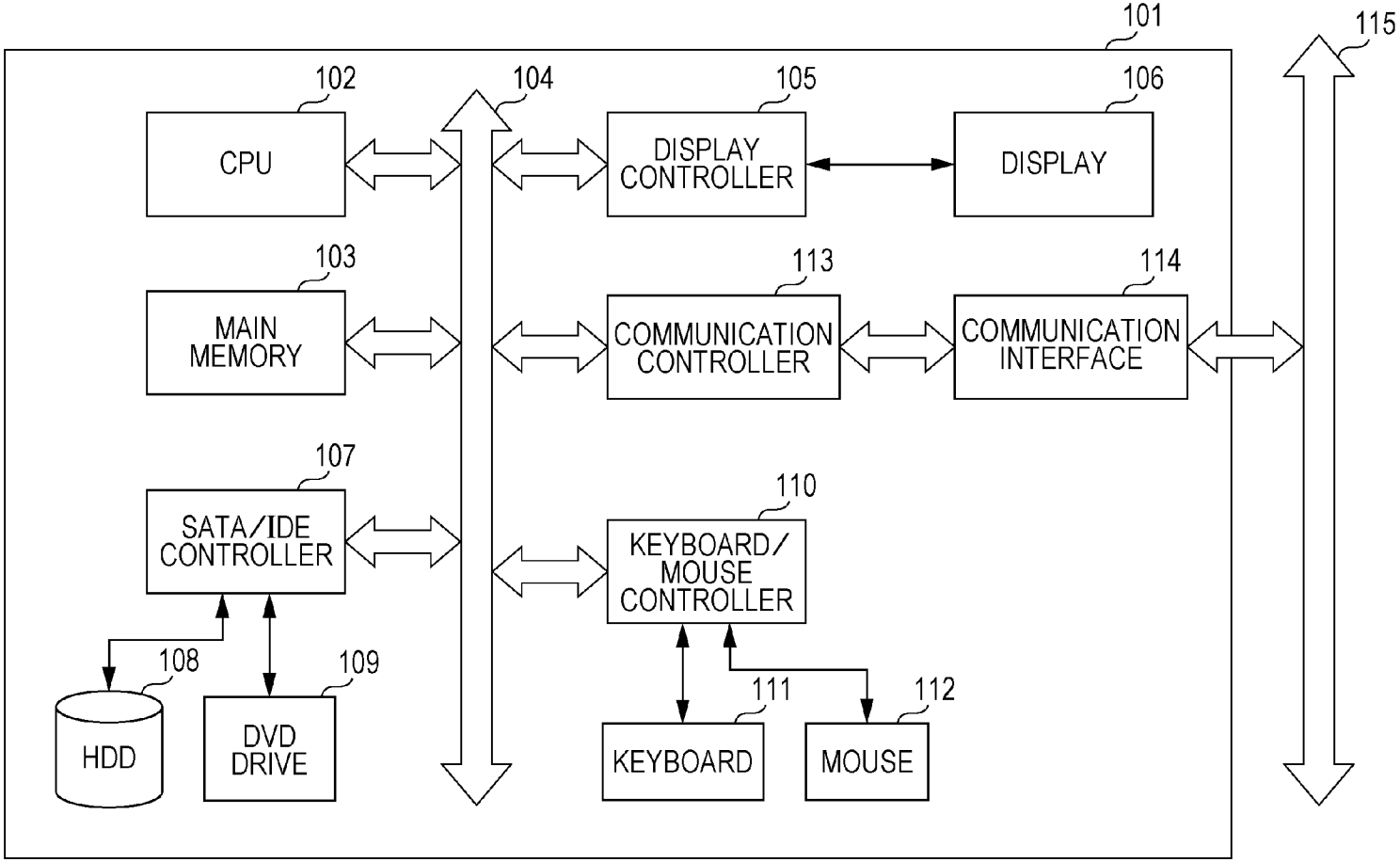
FIG. 1 is a diagram showing an example of a hardware configuration for implementing an electronic system for processing the speech of a particular speaker according to an embodiment of the present invention.

FIG. 1 is a diagram showing an example of a hardware configuration for implementing an electronic system for processing the speech of a particular speaker according to an embodiment of the present invention. As shown in FIG. 1, an electronic system 101 includes one or a plurality of CPUs 102 and a main memory 103, which are connected to a bus 104. The CPU 102 is preferably based on a 32-bit or 64-bit architecture. Examples include CPUs in the Power® series of International Business Machines Corporation®, Core i™ series, Core 2™ series, Atom™ series, Xeon™ series, Pentium® series, and Celeron® series of Intel Corporation®, A series, Phenom™ series, Athlon™ series, Turion™ series, and Sempron™ of Advanced Micro Devices (AMD), Inc., A series of Apple Inc.®, and CPUs for Android terminals. The bus 104 can connect to a display 106, such as a liquid crystal display (LCD), a touch liquid crystal display, or a multitouch liquid crystal display, via a display controller 105. The display 106 can be used to display information, which is displayed when software operating on a computer, for example, a program for an electronic system according to the present invention, operates in the computer 101 via an appropriate graphic interface. The bus 104 can also connect to a disk 108, such as a hard disk or a silicon disk, and a drive 109, such as a CD, a DVD, or a BD drive, via a SATA/IDE controller 107. The bus 104 can further connect to a keyboard 111, a mouse 112, or a touch device (not shown) via a keyboard/mouse controller 110 or a USB bus (not shown).

The disk 108 can store an operating system, such as Windows® OS, UNIX® OS, Mac OS®, or smart phone OS™, such as Android® OS, iOS®, Windows® Phone®, programs for providing a Java® processing environment, a Java® application, a Java® virtual machine (VM), and a Java® Just-In-Time (JIT) compiler, other programs, and data so as to be loaded in the main memory 103.

The drive 109 can be used to install a program, such as an operating system or an application, to the disk 108 from a CD-ROM, a DVD-ROM, or a BD.

A communication interface 114 of the electronic system 101 conforms to, for example, an Ethernet® protocol. The communication interface 114 is connected to the bus 104 via a communication controller 113 and plays the role of physically connecting the electronic system 101 to a communication line 115 and provides a network interface layer for a TCP/IP communication protocol, which is the communication function of the operating system of the electronic system 101. The communication line 115 can be a wired LAN environment, or a wireless LAN environment based on a wireless LAN connection standard, such as IEEE802.11a, b, g, n, i, j, ac, or ad, or long term evolution (LTE).

The electronic system 101 can be a personal computer, such as a desktop computer and a notebook computer, and a server, a cloud terminal, a tablet terminal, a smart phone, a mobile phone, a personal digital assistant, or a portable music player, but is not limited thereto.

The electronic system 101 may be constituted by a plurality of electronic devices. In the case where the electronic system 101 is constituted by a plurality of electronic units, it will also be obvious to those skilled in the art that various changes can be made in the hardware components of the electronic system 101 (for example, see FIG. 8), such as combining them with a plurality of electronic units and distributing the functions thereto. Examples of the plurality of electronic units can include a tablet terminal, a smart phone, a mobile phone, a personal digital assistant, or a portable music player and a server. These changes are of course included in the spirit of the present invention. These components are merely examples, and not all the components are absolutely necessary for the present invention.

For the purpose of easy understanding of the details of the present invention, the manner by which the speech of a particular speaker is processed according to embodiments of the present invention will first be described with reference to the examples of user interfaces shown in FIGS. 2A to 5C. Next, referring to the flowcharts shown in FIGS. 6A to 6D and FIGS. 7A to 7D, processes for processing the speech of a particular speaker according to embodiments of the present invention will be described. Finally, a functional block diagram of the electronic system 101 according to an embodiment of the present invention shown in FIG. 8 will be described.

Figure 2A:
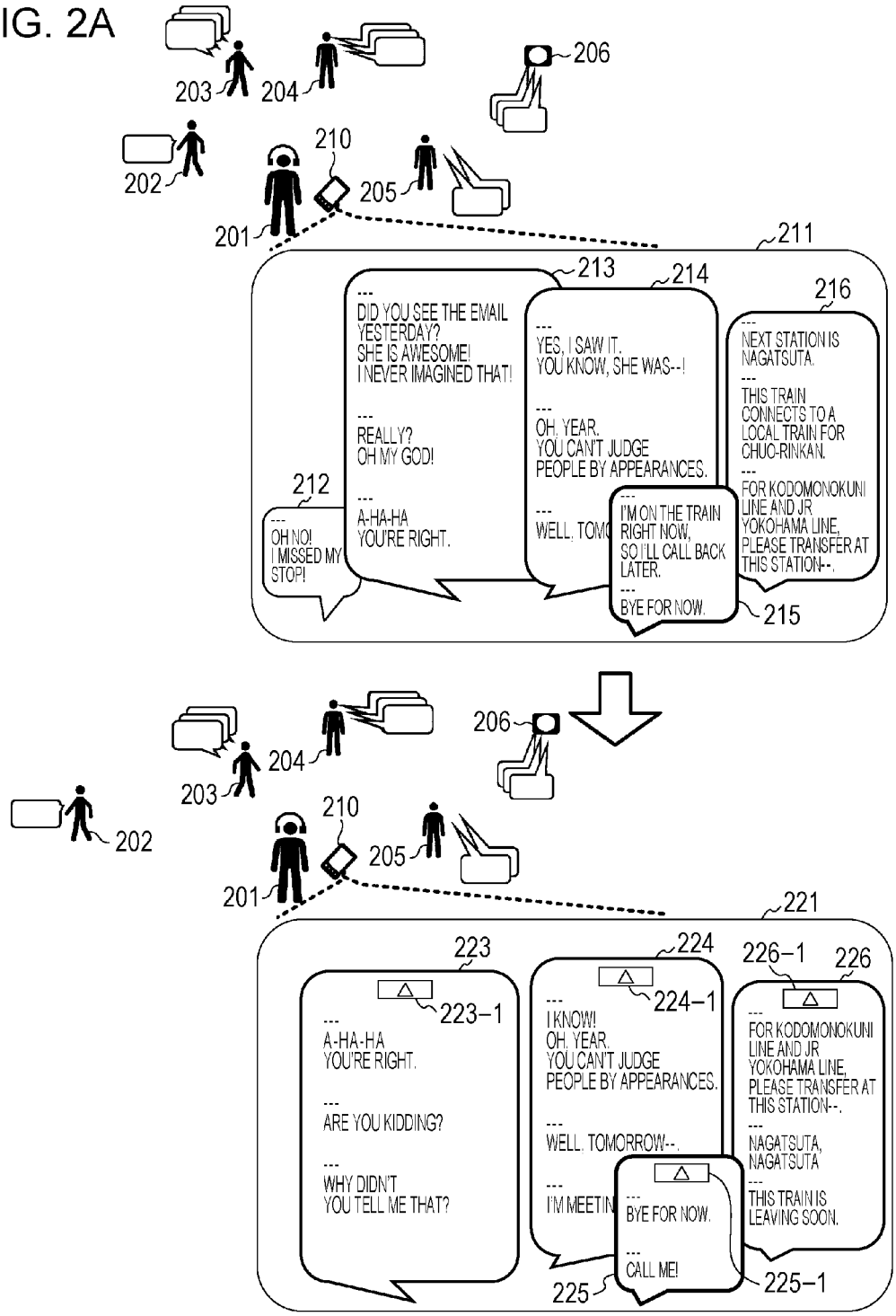
FIG. 2A shows an example of a user interface that groups text corresponding to speech depending on the features of the speech and displays the text for the individual groups, which can be used in an embodiment of the present invention.

FIG. 2A shows an example of a user interface that groups text corresponding to speech depending on the features of the speech and displays the text for the individual groups, which can be used in an embodiment of the present invention.

FIG. 2A shows an example in a train according to an embodiment of the present invention. FIG. 2A shows a user 201 who carries an electronic system 210 according to the present invention and wears a headphone connected to the electronic system 210 by wire or wirelessly, persons 202, 203, 204, and 205 around the user 201, and a loudspeaker 206 installed in the train. An announcement of a conductor of the train is broadcasted from the loudspeaker 206 installed in the train.

First, the upper diagram of FIG. 2A will be described. As shown in FIG. 2A, a user 201 touches an icon associated with a program according to the present invention, which is displayed on a screen 211 of a display installed in the electronic system 210, to start the program. The program causes the electronic system 210 to execute the operations described hereafter.

The electronic system 210 collects ambient sounds via a microphone attached to the electronic system 210. The electronic system 210 analyzes the collected sounds, extracts data associated with speech from the collected sounds, and extracts the features of the speech from the data. The sounds may include noise in the outside together with speech. The extraction of the features of speech can be executed by using, for example, a speaker verification technique that is known to those skilled in the art. Subsequently, the electronic system 210 groups the speech by speech estimated to be generated from the same person on the basis of the extracted features. One group unit can correspond to one speaker. Accordingly, grouping speech can result in grouping speech by speakers. However, the automatic grouping made by the electronic system 210 is not always correct. In this case, the incorrect grouping can be corrected by the user 201 by using a grouping correction method (separation and merging of groups) described below with reference to FIGS. 3A and 3B.

The electronic system 210 converts the grouped speech to text. The speech-to-text conversion can be performed by using, for example, a speech recognition technique that is known to those skilled in the art. The electronic system 210 can display the text corresponding to the speech (text speech) on the display provided on the electronic system 210 in accordance with the grouping. Since a single group corresponds to a single speaker, as described above, text corresponding to the speech of a single speaker associated with a single group can be displayed in the group. The electronic system 210 can display the grouped text of the individual groups in chronological order. The electronic system 210 may display a group, including text corresponding to the latest speech, in the forefront of the screen 211 or may display a group associated with the person 205 who is present at a position closest to the user 201 in the forefront of the screen 211.

The electronic system 210 can change a display method or coloring of text in the groups in accordance with the volumes, pitches, qualities of the speech, or other features of the speech of speakers associated with the individual groups. In the case where a method for displaying text is to be changed, for example, the volumes of speech can be expressed by varying the sizes of a two-dimensional display of the text, the pitches of speech can be expressed in three-dimensional text, the sound qualities can be expressed by the gradation levels of the text, and the features of speech can be expressed by the differences in text font. In the case where the coloring of text is to be changed, for example, the volumes of speech can be expressed in different colors for the individual groups. For the pitches of speech, for example, a high-pitched sound is expressed by a yellow line, and a low-pitched sound is expressed by a blue line. For the sound quality, for example, a man can be expressed by a blue outline, a woman can be expressed by a red outline, a child can be expressed by a yellow outline, and others are expressed by a green outline. The features of speech can be expressed by the gradation levels of the text.

In FIG. 2A, the electronic system 210 groups the collected speech into five groups, that is, groups 212, 213, 214, 215, and 216. The groups 212, 213, 214, and 215 correspond to (or are associated with) the persons 202, 203, 204, and 205, respectively, and the group 216 corresponds to (or is associated with) the loudspeaker 206. The electronic system 210 displays text corresponding to the speech in the individual groups 212, 213, 214, 215, and 216 in chronological order. The electronic system 210 can display the individual groups 212, 213, 214, 215, and 216, on the display, at positions close to the directions in which the persons 202, 203, 204, and 205 and the loudspeaker 206 associated with the individual groups 212, 213, 214, 215, and 216, respectively, (that is, speech sources) are present or in such a manner as to correspond to the directions and the relative distances between the user 201 and the individual groups 212, 213, 214, 215, and 216.

Next, the lower diagram of FIG. 2A will be described. As shown in the lower diagram of FIG. 2A, the electronic system 210 further collects ambient sounds via the microphone. The electronic system 210 further analyzes the collected sounds, extracts data associated with speech from the collected sounds, and newly extracts the features of the speech from the data. The electronic system 210 groups the speech on the basis of the newly extracted features by speech estimated to be generated from the same person. The electronic system 210 identifies, among the groups 212, 213, 214, 215, and 216, groups that the grouped speech belongs to on the basis of the newly extracted features. Alternatively, the electronic system 210 may identify groups that the speech belongs to, on the basis of the newly extracted features, without grouping the speech into the groups 212, 213, 214, 215, and 216. The electronic system 210 can convert the grouped speech to text and can display the text in chronological order in the individual groups shown in the upper diagram of FIG. 2A. The electronic system 210 can make the text in the individual groups displayed in the upper diagram of FIG. 2A visible on the screen in ascending order by time, so as to display the latest text. In other words, the electronic system 210 can replace the text in the individual groups with the latest text rendering previously displayed text invisible. The user 201 can view hidden text by touching, for example, up-pointing triangular icons 223-1, 224-1, 225-1, and 226-1 displayed in individual groups 223, 224, 225, and 226. Alternatively, the user 201 can view hidden text by swiping his/her finger upwards in the individual groups 223, 224, 225, and 226. Alternatively, scroll bars may be displayed in each of the groups 223, 224, 225, and 226, so that the user 201 can view hidden text by swiping the scroll bar. Furthermore, the user 201 can view the latest text by touching, for example, down-pointing triangular icons (not shown) displayed in the individual groups 223, 224, 225, and 226. Alternatively, the user 201 can view the latest text by swiping his/her finger downwards in each of the groups 223, 224, 225, and 226. Alternatively, a scroll bar may be displayed in each of the groups 223, 224, 225, and 226, so that the user 201 can view the latest text by sliding the scroll bar.

In the case where the persons 202, 203, 204, and 205 move with time, the electronic system 210 can move the display positions of the individual groups 212, 213, 214, and 215 to display the individual groups 212, 213, 214, and 215, on the display, at positions close to directions in which the persons 202, 203, 204, and 205 associated with the individual groups 212, 213, 214, and 215 (that is, speech sources) have moved or in such a manner as to correspond to the directions and the relative distances between the user 201 and the individual groups 212, 213, 214, and 215, and can display the individual groups 212, 213, 214, and 215 again (see, a screen 221).

Since the speech of the person 202 in the upper diagram of FIG. 2A is outside a range in which the microphone of the electronic system 210 of the user 201 can collect sounds, the group 212 corresponding to the person 202 is eliminated in the screen 221.

Furthermore, in the case where the user 201 moves with time, the electronic system 210 can move the display positions of the individual groups 212, 213, 214, 215, and 216 so as to display the individual groups 212, 213, 214, 215, and 216 on the display in accordance with directions in which the individual persons 202, 203, 204, and 205 and the loudspeaker 206 are viewed from the user 201, or the directions and the relative distances between the user 201 and the individual groups 212, 213, 214, 215, and 216, and can display the individual groups 212, 213, 214, 215, and 216 again (see, the screen 221).

Figure 2B:
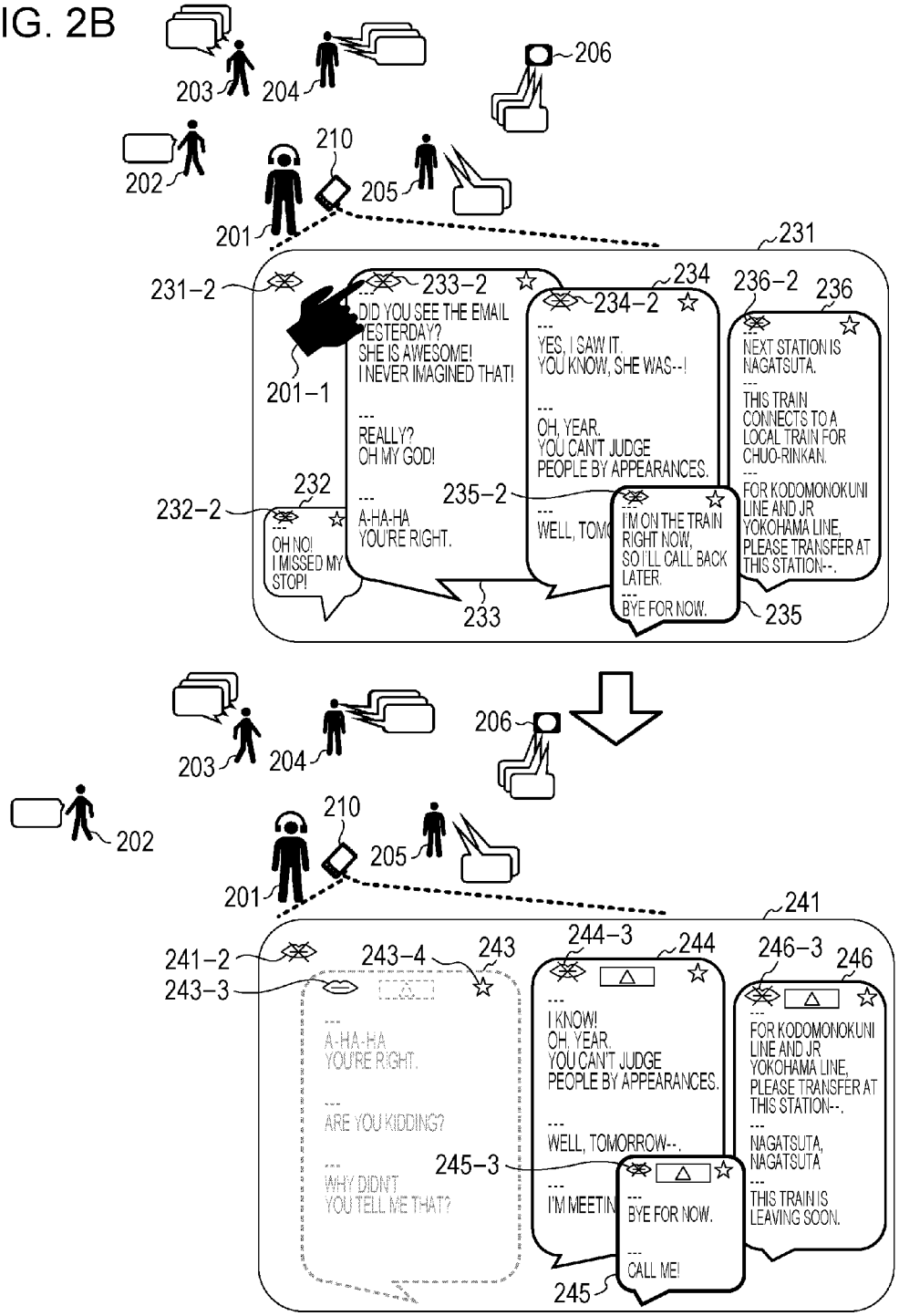
FIG. 2B shows an example in which only the speech of a particular speaker is selectively reduced or cancelled in the example of FIG. 2A according to an embodiment of the present invention.

FIG. 2B shows an example in which only the speech of a particular speaker is selectively reduced or cancelled in the example of FIG. 2A according to an embodiment of the present invention. The upper diagram of FIG. 2B is the same as the upper diagram of FIG. 2A, except that an icon 231-2 in a lip shape with X (cross) is displayed at the upper left corner of a screen 231, and icons 232-2, 233-2, 234-2, 235-2, and 236-2 in a lip shape with X and star-shaped icons are displayed in the individual groups 232, 233, 234, 235, and 246. The icon 231-2 is used to reduce or cancel, via the headphone, all the speech of speakers associated with all the groups 232, 233, 234, 235, and 236 displayed on the screen 231. The icons 232-2, 233-2, 234-2, 235-2, and 236-2 are used to selectively reduce or cancel the speech of groups associated therewith, via the headphone.

Assume that the user 201 wants to reduce or cancel only the speech of the speaker associated with the group 233. The user 201 touches the icon 233-2 in the group 233 with a finger 201-1. The electronic system 210 receives the touch of the user 201 and can selectively reduce or cancel only the speech of the speaker associated with the group 233 corresponding to the icon 233-2 via the headphone.

The lower diagram of FIG. 2B shows a screen 241 in which only the speech of the speaker associated with the group 243 (corresponding to the group 233) is selectively reduced. The text in the group 243 is displayed faintly. The electronic system 210 can gradually decrease the volume of the speech of the speaker associated with the group 243, for example, as the number of touches on an icon 243-3 increases to finally cancel the speech completely.

In the case where the user 201 wants to increase the volume of the speech of the speaker associated with the group 243 again, the user 201 touches an icon 243-4 with the finger 201-1. The icon 243-3 is an icon for decreasing (reducing or cancelling) the volume of the speech; in contrast, the icon 243-4 is an icon for increasing (enhancing) the volume of the speech.

Also for the other groups 244, 245, and 246, by touching an icon 244-3, 245-3, or 246-3 with the finger 201-1, the user 201 can reduce or cancel a series of speech inputs associated with a group corresponding to the icon touched.

The group corresponding to the person 202 is eliminated in the screen 241 because the speech of the person 202 in the upper diagram of FIG. 2B is outside a range in which the microphone of the electronic system 210 of the user 201 can collect sounds.

In the example shown in the upper diagram of FIG. 2B, by touching the icon 232-2, 233-2, 234-2, 234-2, 235-2, or 236-2 on the screen 231, a series of speech inputs of a speaker associated with the group 232, 233, 234, 235, or 236 corresponding to the touched icon can be selectively reduced or cancelled. Alternatively, by drawing, for example, X, in the area in the group 232, 233, 234, 235, or 236 with the finger 201-1, the user 201 can selectively reduce or cancel the series of speech inputs of a speaker associated with the group in which X is drawn. This also applies to the screen 241. Alternatively, the electronic system 210 can switch between reduction/cancellation and enhancement of speech in the same group by repeating touching in the areas of the individual groups 232, 233, 234, 235, and 236.

Figure 2C:
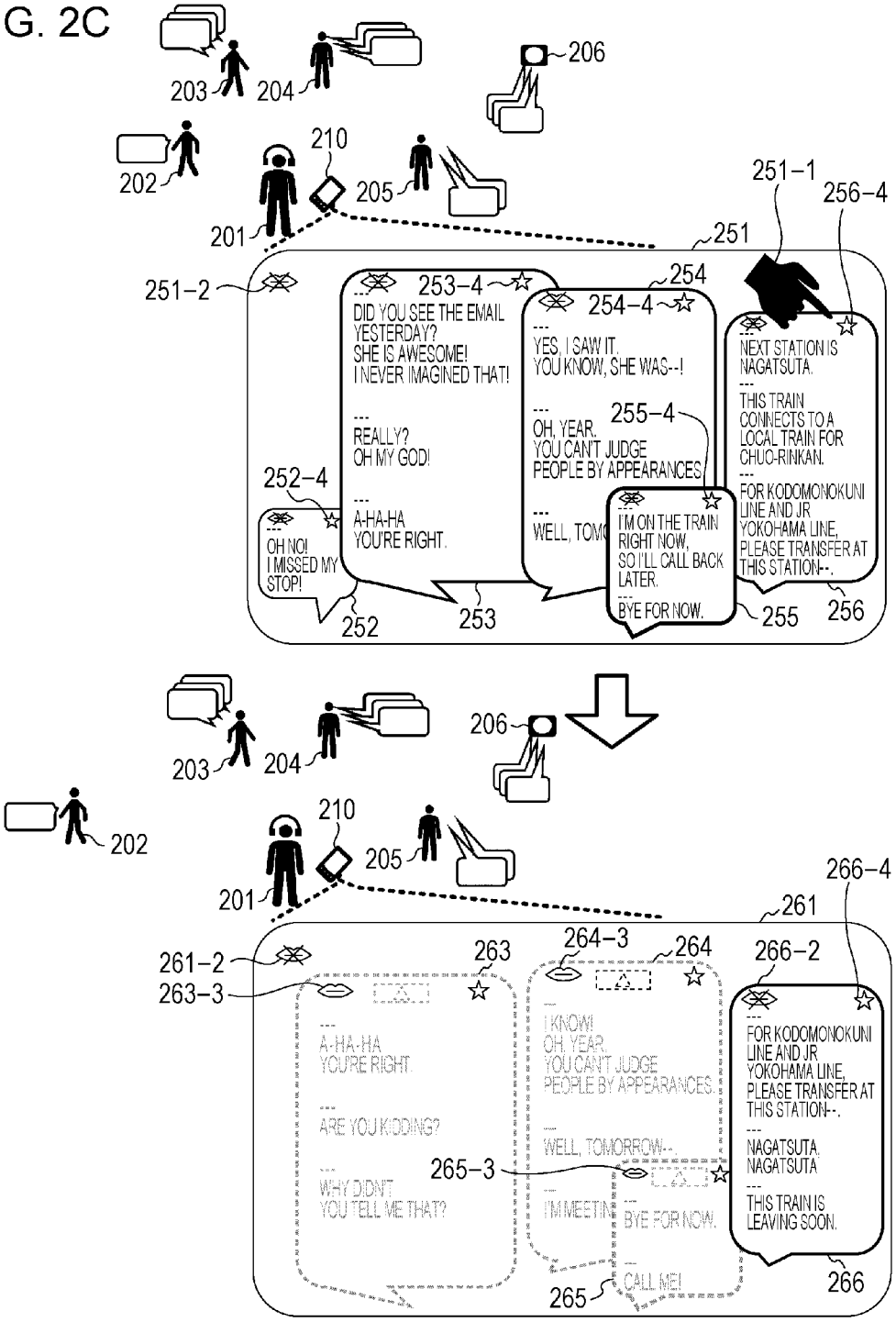
FIG. 2C shows an example in which only the speech of a particular speaker is selectively enhanced in the example of FIG. 2A according to an embodiment of the present invention.

FIG. 2C shows an example in which only the speech of a particular speaker is selectively enhanced in the example of FIG. 2A according to an embodiment of the present invention. The upper diagram of FIG. 2C is the same as the upper diagram of FIG. 2B. Icons 252-4, 253-4, 254-4, 255-4, and 256-4 are used to selectively enhance a series of speech inputs of speakers associated therewith via the headphone.

Assume that the user 201 wants to enhance only the speech of a speaker associated with a group 256. The user 201 touches a star-shaped icon 256-4 in the group 256 with a finger 251-1. The electronic system 210 receives the touch from the user 201 and can selectively enhance only the speech of the speaker associated with the group 256 corresponding to the icon 256-4. The electronic system 210 can optionally automatically reduce or cancel a series of speech inputs of the individual speakers associated with groups 253, 254, and 255 other than the group 256.

The lower diagram of FIG. 2C shows a screen 261 in which only the speech of a speaker associated with a group 266 (corresponding to the group 256) is selectively enhanced. The text in the groups 263, 264, and 265 other than the group 266 is faintly displayed. In other words, the speech of the speakers associated with the individual groups 263, 264, 265, and 266 is automatically reduced or cancelled. The electronic system 210 can gradually increase the volume of the speech of the speaker associated with the group 266, for example, as the number of touches on an icon 266-4 increases. Furthermore, the electronic system 210 can, optionally, gradually decrease the volumes of the speech of the speakers associated with the other groups 263, 264, and 265 as the volume of the speech of the speaker associated with the group 266 gradually increases to finally cancel the speech completely.

In the case where the user 201 wants to decrease the volume of the speech of the speaker associated with the group 266 again, the user 201 touches an icon 266-2 with the finger 251-1.

The group 252 corresponding to the person 202 is eliminated in the screen 261 because the speech of the person 202 in the upper diagram of FIG. 2C is outside the range in which the microphone of the electronic system 210 of the user 201 can collect sounds.

In the example shown in the upper diagram of FIG. 2C, by touching the icon 252-4, 253-4, 254-4, 255-4, or 256-4 on a screen 251, a series of speech inputs of a speaker associated with the group 252, 253, 254, 255, or 256 corresponding to the icon 252-4, 253-4, 254-4, 255-4, or 256-4 can be selectively enhanced. Alternatively, by drawing, for example, substantially a circular shape (O), with a finger, in the area in the group 252, 253, 254, 255, or 256, the user 201 can selectively enhance the series of speech inputs of a speaker associated with the group in which the substantially circular shape (O) is drawn. This also applies to the screen 261.

The example in the upper diagram of FIG. 2C shows that only the speech of the speaker associated with the group 256 can be enhanced by the user 201 touching the star-shaped icon 256-4 in the group 256. Alternatively, the user 201 may enhance only the speech of the speaker associated with the group 256 by touching an icon 251-2 in the screen 251 to reduce or cancel all the speech of the speakers associated with all the groups 252, 243, 254, 255, and 256 in the screen 251 and thereafter touching the icon 256-4 in the group 256. Alternatively, the electronic system 210 can switch between enhancement and reduction/cancellation of the speech in the same group by the user 201 repeating touching in the areas of the groups 252, 243, 254, 255, and 256.

Figure 3A:
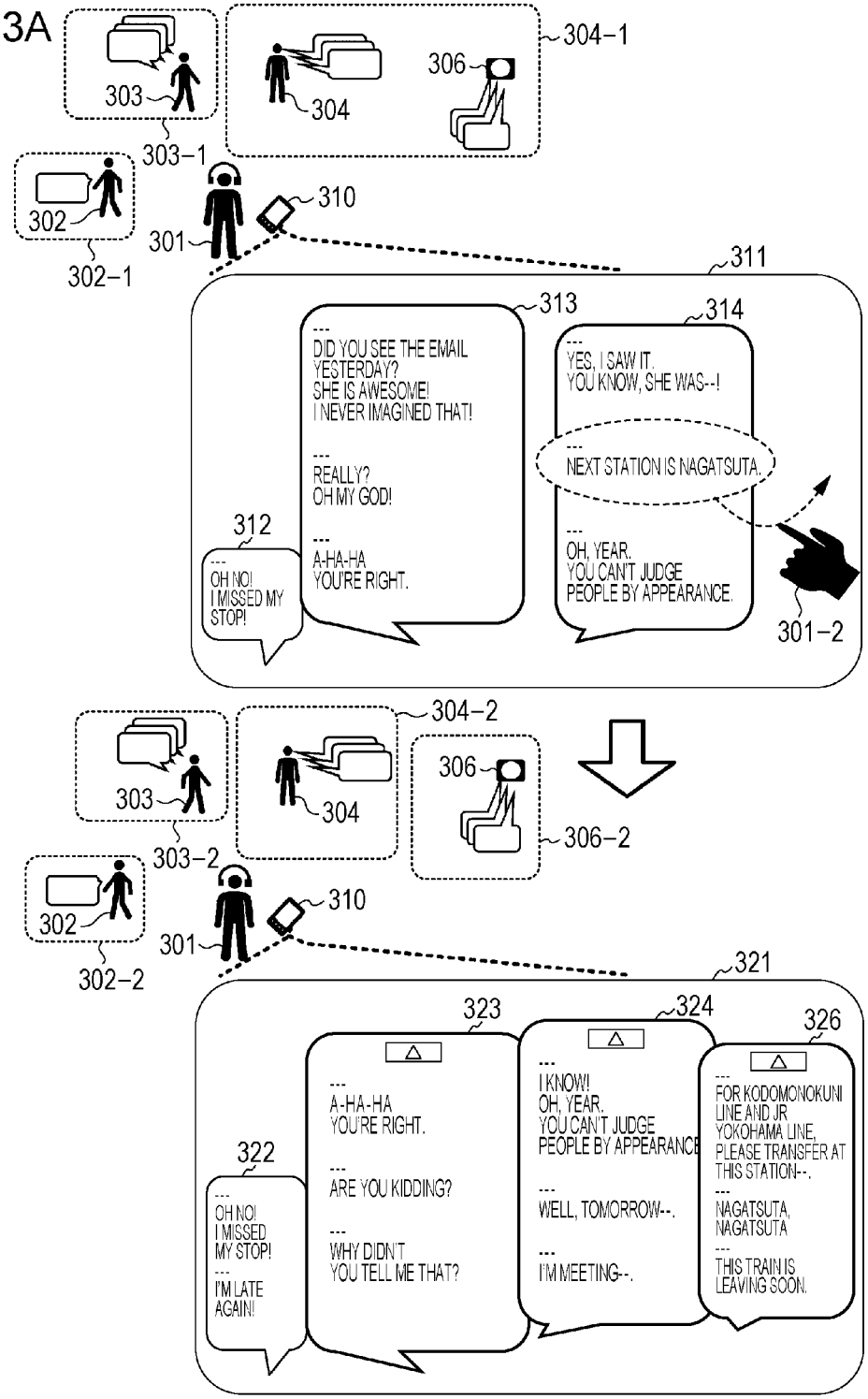
FIG. 3A shows an example of a user interface that allows a method for correcting grouping (separation), which can be used in an embodiment of the present invention.

FIG. 3A shows an example of a user interface that allows a method for correcting grouping (separation), which can be used in an embodiment of the present invention. FIG. 3A shows an example in a train according to an embodiment of the present invention. FIG. 3A shows a user 301 who carries an electronic system 310 according to the present invention and wears a headphone connected to the electronic system 310 by wire or wirelessly, persons 302, 303, and 304 around the user 301, and a loudspeaker 306 installed in the train. An announcement of a conductor of the train is broadcasted from the loudspeaker 306 installed in the train.

First, the upper diagram of FIG. 3A will be described. The electronic system 310 collects ambient sounds via a microphone attached to the electronic system 310. The electronic system 310 analyzes the collected sounds, extracts data associated with speech from the collected sounds, and extracts the features of the speech from the data. Subsequently, the electronic system 310 groups the speech by speech estimated to be generated from the same person on the basis of the extracted features. The electronic system 310 converts the grouped speech to text. The result is shown in the upper diagram of FIG. 3A.

In FIG. 3A, the speech is grouped into three groups 312, 313, and 314 (corresponding to groups 302-1, 303-1, and 304-1, respectively) in accordance with the grouping. However, speech from the person 304 and the speech from the loudspeaker 306 are combined into the single group 314. In other words, the electronic system 310 estimates the plurality of speakers as a single group by mistake.

Assume that the user 301 wants to separate the speech from the loudspeaker 306 as another group from the group 314. The user 301 encloses the text to be separated with a finger 301-2 to select it and drags the text outside the group 314 (see the arrow).

In response to the drag, the electronic system 310 recalculates the feature of the speech of the person 304 and the feature of the speech from the loudspeaker 306 and distinguishes the features thereof. The electronic system 310 uses the recalculated features when grouping the speech after the recalculation.

The lower diagram of FIG. 3A shows that a group 324 corresponding to the group 314 and a group 326 corresponding to the text separated from the group 314 are displayed on a screen 321 after the recalculation. The group 326 is associated with the loudspeaker 306.

Figure 3B:
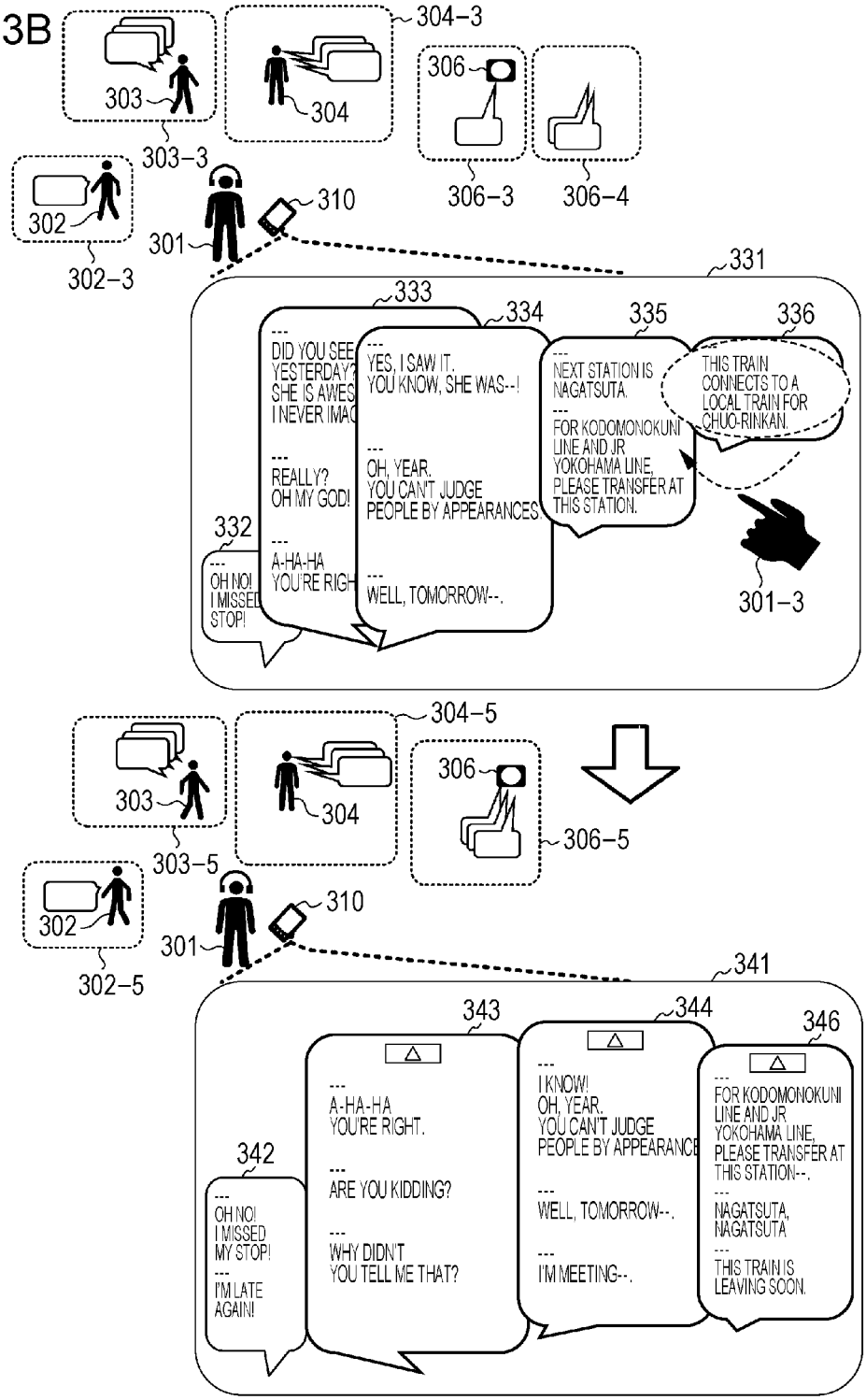
FIG. 3B shows an example of a user interface that allows a method for correcting grouping (merging), which can be used in an embodiment of the present invention.

FIG. 3B shows an example of a user interface that allows a method for correcting grouping (merging), which can be used in an embodiment of the present invention. FIG. 3B shows an example according to an embodiment of the present invention, showing the same situation in a train as in the upper diagram of FIG. 3A. First, the upper diagram of FIG. 3B will be described.

The electronic system 310 collects ambient sounds via the microphone attached to the electronic system 310. The electronic system 310 analyzes the collected sounds, extracts data associated with speech from the collected sounds, and extracts the features of the speech from the data. Subsequently, the electronic system 310 groups the speech by speech estimated to be generated from the same person on the basis of the extracted features. The electronic system 310 converts the grouped speech to text. The result is shown in the upper diagram of FIG. 3B.

In FIG. 3B, the speech is grouped into five groups 332, 333, 334, 335, and 336 (corresponding to 302-3, 303-3, 304-3, 306-3, and 306-4, respectively) according to the grouping. However, the groups 335 and 336 are separated as two different kinds of speech although they are both generated from the loudspeaker 306. In other words, the electronic system 310 estimates a single speaker as two groups by mistake.

Assume that the user 301 wants to merge the group 335 and the group 336 together. The user 301 encloses the text to be merged with a finger 301-3 to select it and drags the text into the group 335 (see the arrow).

In response to the drag, the electronic system 310 deals with the speech grouped into the feature group of the group 335 and the speech grouped into the feature group of the group 336 as a single group when grouping of the speech after the drag. Alternatively, the electronic system 310 may extract a feature common to the group 335 and the group 336 in accordance with the drag and may group the speech after the drag by using the extracted common feature.

The lower diagram of FIG. 3B shows that a group 346 in which the groups 335 and 336 are merged is displayed on a screen 341 after the drag. The group 346 is associated with the loudspeaker 306.

Figure 4A:
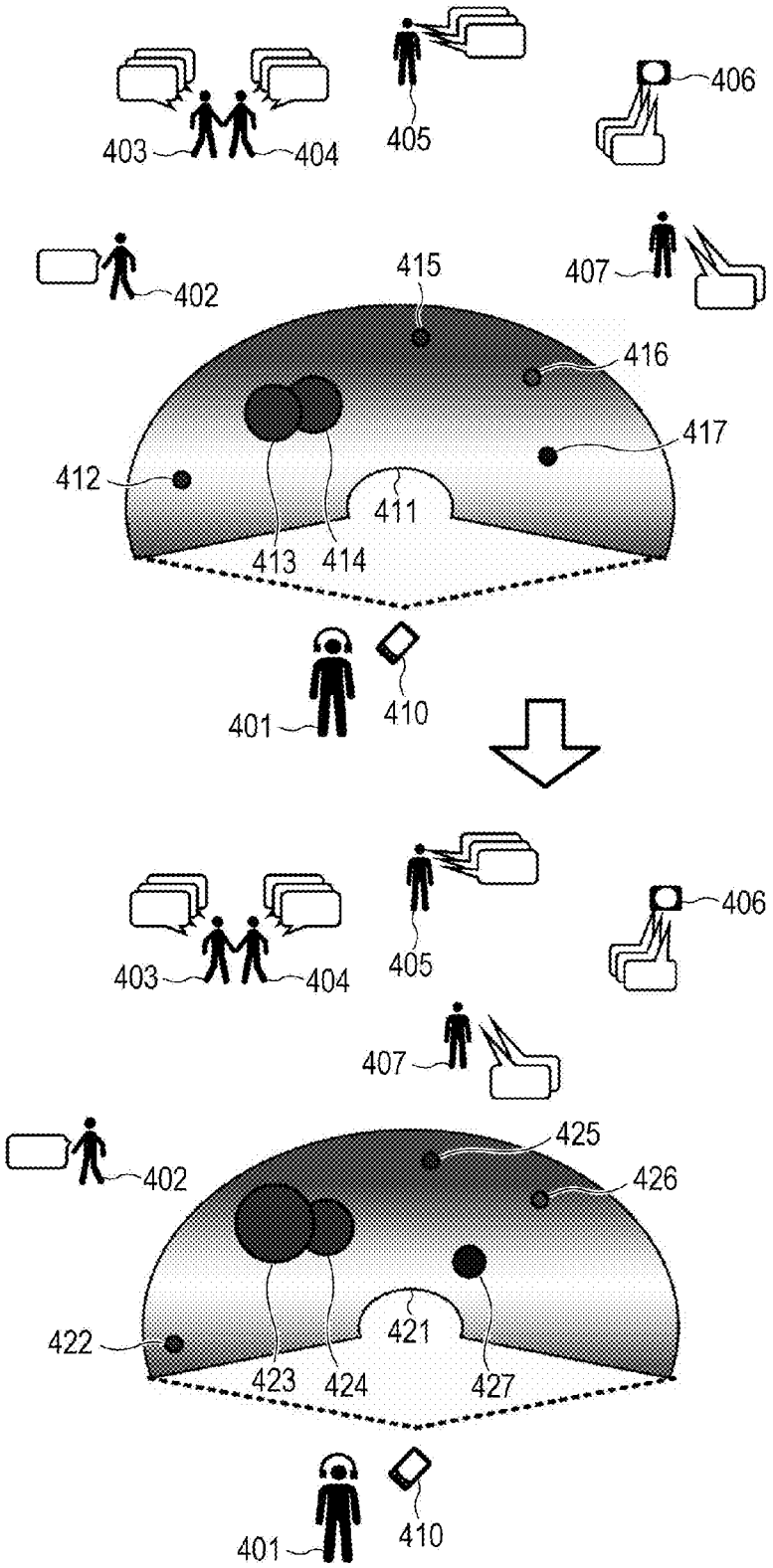
FIG. 4A shows an example of a user interface that groups speech by the features of the speech and displaying the individual groups, which can be used in an embodiment of the present invention.

FIG. 4A shows an example of a user interface that groups speech by the features of the speech and displaying the individual groups, which can be used in an embodiment of the present invention. FIG. 4A shows an example in a train according to an embodiment of the present invention. FIG. 4A shows a user 401 who carries an electronic system 410 according to the present invention and wears a headphone connected to the electronic system 410 by wire or wirelessly, persons 402, 403, 404, 405, and 407 around the user 401, and a loudspeaker 406 installed in the train. An announcement of a conductor of the train is broadcasted from the loudspeaker 406 installed in the train.

First, the upper diagram of FIG. 4A will be described. The user 401 touches an icon associated with a program according to the present invention, which is displayed on a screen 411 of a display installed in the electronic system 410, to start the program. The program causes the electronic system 410 to execute the operations described hereafter.

The electronic system 410 collects ambient sounds via a microphone attached to the electronic system 410. The electronic system 410 analyzes the collected sounds, extracts data associated with speech from the collected sounds, and extracts the features of the speech from the data. Subsequently, the electronic system 410 groups the speech by speech estimated to be generated from the same person on the basis of the extracted features. One group unit can correspond to one speaker. Accordingly, grouping speech can result in grouping speech by speakers. However, the automatic grouping made by the electronic system 410 is not always correct. In this case, the incorrect grouping can be corrected by the user 401 by using the grouping correction method (separation and merging of groups) described with reference to FIGS. 3A and 3B.

In FIG. 4A, the electronic system 410 groups the collected speech into six groups, that is, groups 412, 413, 414, 415, 416, and 417. The electronic system 410 can display the individual groups 412, 413, 414, 415, 416, and 417, on the display, at positions close to directions in which persons associated with the individual groups 412, 413, 414, 415, 416, and 417 (that is, speech sources) are present or so as to correspond to the directions and the relative distances between the user 401 and the individual groups 412, 413, 414, 415, 416, and 417 (the circles in FIG. 4A correspond to the individual groups 412, 413, 414, 415, 416, and 417). The user interface of the electronic system 410 allows the user 401 to intuitively identify speakers on the screen 411. The groups 412, 413, 414, 415, and 417 correspond to (or are associated with) the persons 402, 403, 404, 405, and 407, respectively, and the group 416 corresponds to (or is associated with) the loudspeaker 406.

The electronic system 410 can display the individual groups 412, 413, 414, 415, 416, and 417 in different colors on the basis of the features thereof, for example, the volumes, pitches, or qualities of the speech, or the features of the speech of speakers associated with the individual groups. For example, for men, the circles of the groups (for example, the groups 416 and 417) are displayed in blue; for women, the circles of the groups (for example, the groups 412 and 413 are displayed in red; and for inanimate objects (speech from a loudspeaker), the circles of the groups (for example, the group 416) can be displayed in green. The circles of the groups can be changed depending on the volumes of the speech. For example, the circle can be increased in size as the volume of the speech increases. Furthermore, the circles of the groups can be changed depending on the level of the sound quality. For example, the color of the rims of the circles can be made deeper as the level of the sound quality decreases.

Next, the lower diagram of FIG. 4A will be described. Subsequently, the electronic system 410 further collects ambient sounds via the microphone. The electronic system 410 analyzes the collected sounds, extracts data associated with speech from the collected sounds, and newly extracts the features of the speech from the data. The electronic system 410 groups the speech on the basis of the newly extracted features by speech estimated to be generated from the same person. The electronic system 410 identifies, among the groups 412, 413, 414, 415, 416, and 417, groups that the grouped speech belongs to on the basis of the newly extracted features. Alternatively, the electronic system 410 may identify groups that the speech belongs to, on the basis of the newly extracted features, without grouping the speech into the groups 412, 413, 414, 415, 416, and 417.

In the case where persons 402, 403, 404, 405, and 407 move with time, the electronic system 410 can move the display positions of the individual groups 412, 413, 414, 415, and 417 so as to display the individual groups 412, 413, 414, 415, and 417, on the display, at positions close to directions in which the persons 402, 403, 404, 405, and 207 associated with the individual groups 412, 413, 414, 415, and 417 (that is, speech sources) have moved or the directions and the relative distances between the user 401 and individual groups 412, 413, 414, 415, and 417 and can display the individual groups 412, 413, 414, 415, and 417 again (see, a screen 421). Furthermore, in the case where the user 401 moves with time, the electronic system 410 can move the display positions of the individual groups 412, 413, 414, 415, 417, and 416 so as to display the individual groups 412, 413, 414, 415, 417, and 416, on the display, in directions in which the persons 402, 403, 404, 405, and 207 and the loudspeaker 406 are viewed from the user 401 or the directions and the relative distances between the user 401 and individual groups 412, 413, 414, 415, 417, and 416 and can display the individual groups 412, 413, 414, 415, 417, and 416 again (see, the screen 421).

The lower diagram of FIG. 4A shows the positions after the regeneration with circles 422, 423, 424, 425, 426, and 427. The group 427 corresponds to the group 417. Since the speaker associated with the group 417 has moved, the circle that indicates the group 427 on the screen 421 differs from that on the screen 411. The fact that the circles of the regenerated groups 423 and 427 are larger than those of the groups 413 and 417 before the regeneration shows that the volumes of speech of the speakers associated with the groups 423 and 427 have increased. The electronic system 410 allows the user 401 to easily identify a speaker whose voice has increased in volume by alternately displaying the circular icons of the regenerated groups 423 and 427 and the circular icons of the groups 413 and 417 before the regeneration (flashing).

Figure 4B:
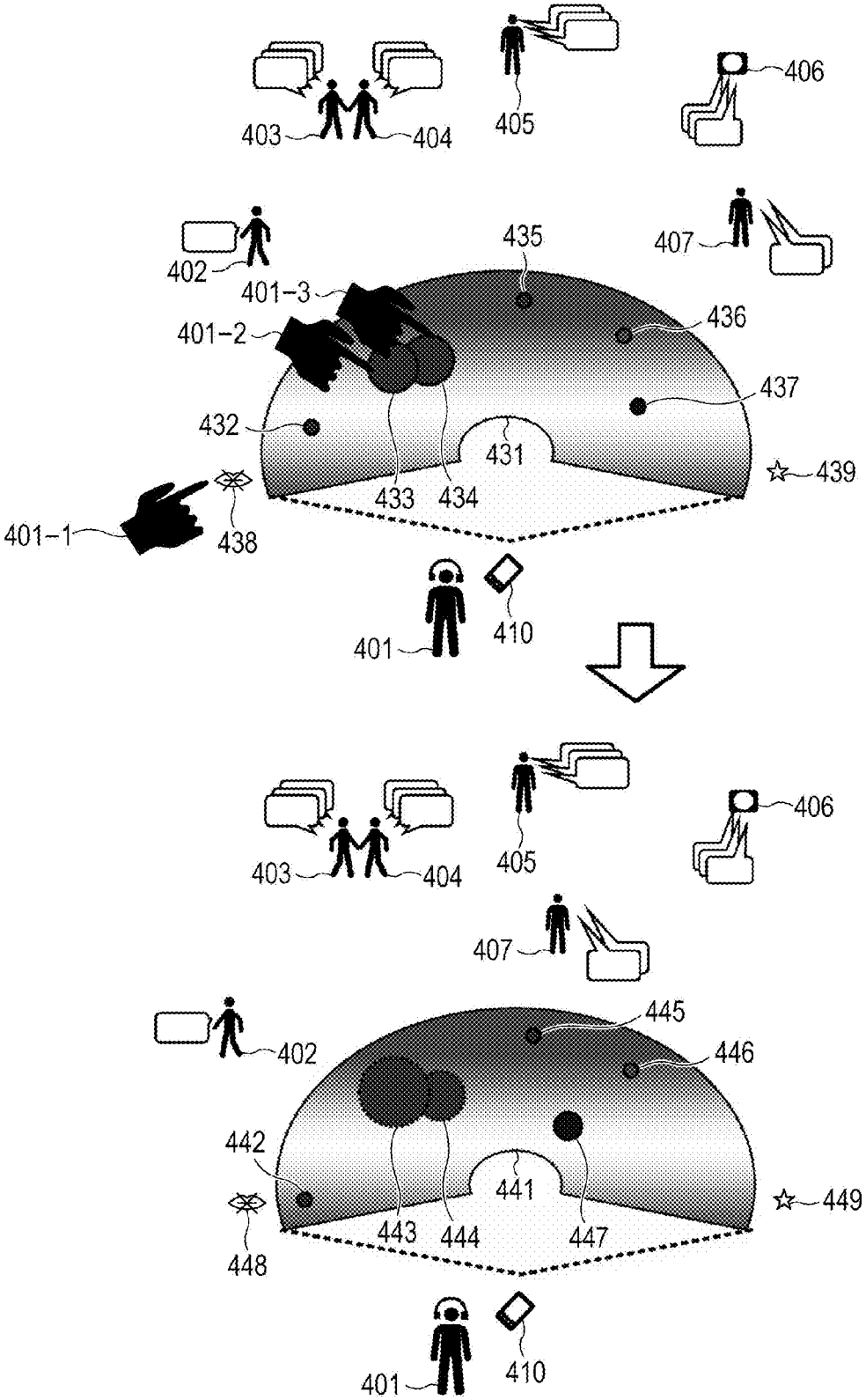
FIG. 4B shows an example in which only the speech of a particular speaker is selectively reduced or cancelled in the example of FIG. 4A according to an embodiment of the present invention.

FIG. 4B shows an example in which only the speech of a particular speaker is selectively reduced or cancelled in the example of FIG. 4A according to an embodiment of the present invention. The upper diagram of FIG. 4B is the same as the upper diagram of FIG. 4A, except that an icon 438 in a lip shape with X is displayed at the lower left corner of a screen 431, and a star-shaped icon 439 is displayed at the lower right corner of the screen 431. The icon 438 is used to reduce or cancel, via the headphone, the speech of a speaker associated with a group touched by the user 401 from among the groups 432, 433, 434, 435, 436, and 437 displayed on the screen 431. The icon 439 is used to enhance, via the headphone, all the speech of a speaker associated with a group touched by the user 401 from among the groups 432, 433, 434, 435, 436, and 437 displayed on the screen 431.

Assume that the user 401 wants to reduce or cancel only the speech of two speakers associated with the groups 433 and 434. The user 401 first touches the icon 438 with a finger 401-1. Next, the user 401 touches the area in the group 433 with a finger 401-2 and next touches the area in the group 434 with a finger 401-3. The electronic system 410 receives the touches from the user 401 and can selectively reduce or cancel only the speech of the speakers associated with the groups 433 and 434.

The lower diagram of FIG. 4B shows a screen 441 in which only the speech of the speakers associated with groups 443 and 444 (corresponding to the groups 433 and 434, respectively) is selectively reduced. The outlines of the groups 443 and 444 are shown by dotted lines. The electronic system 410 can gradually decrease the volume of the speech of the speaker associated with the group 443 as the number of touches in the area of the group 443 increases to finally cancel the speech completely. Likewise, the electronic system 410 can gradually decrease the volume of the speech of the speaker associated with the group 444 as the number of touches in the area of the group 444 increases to finally cancel the speech completely.

In the case where the user 401 wants to increase the volume of the speech of the speaker associated with the group 443 again, the user 401 touches an icon 449 with a finger and next touches the area in the group 443. Likewise, in the case where the user 401 wants to increase the volume of the speech of the speaker associated with the group 444 again, the user 401 touches the icon 449 with a finger and next touches the area in the group 444.

Also, for the other groups 432, 435, 436, or 437, by touching the icon 438 and thereafter touching the area in the group 432, 435, 436, or 437 with a finger, the user 401 can reduce or cancel the speech of the speaker associated with a group corresponding to the touched area.

In the upper diagram of FIG. 4B, by touching the icon 438 and thereafter touching the area in the group 432, 433, 434, 435, 436, or 437 on the screen 431, the user 401 can selectively reduce or cancel the speech of a speaker associated with the group 432, 433, 434, 435, 436, or 437 corresponding to the area touched. Alternatively, by drawing, for example, X, with a finger on the area in the group 432, 433, 434, 435, 436, or 437, the user 401 can selectively reduce or cancel the speech of a speaker associated with the group in which the X mark is drawn. This also applies to the screen 441. Alternatively, by repeating touching in the area of the group 432, 433, 434, 435, 436, or 437, the electronic system 410 can switch between reduction/cancellation and enhancement of speech in the same group.

Figure 4C:
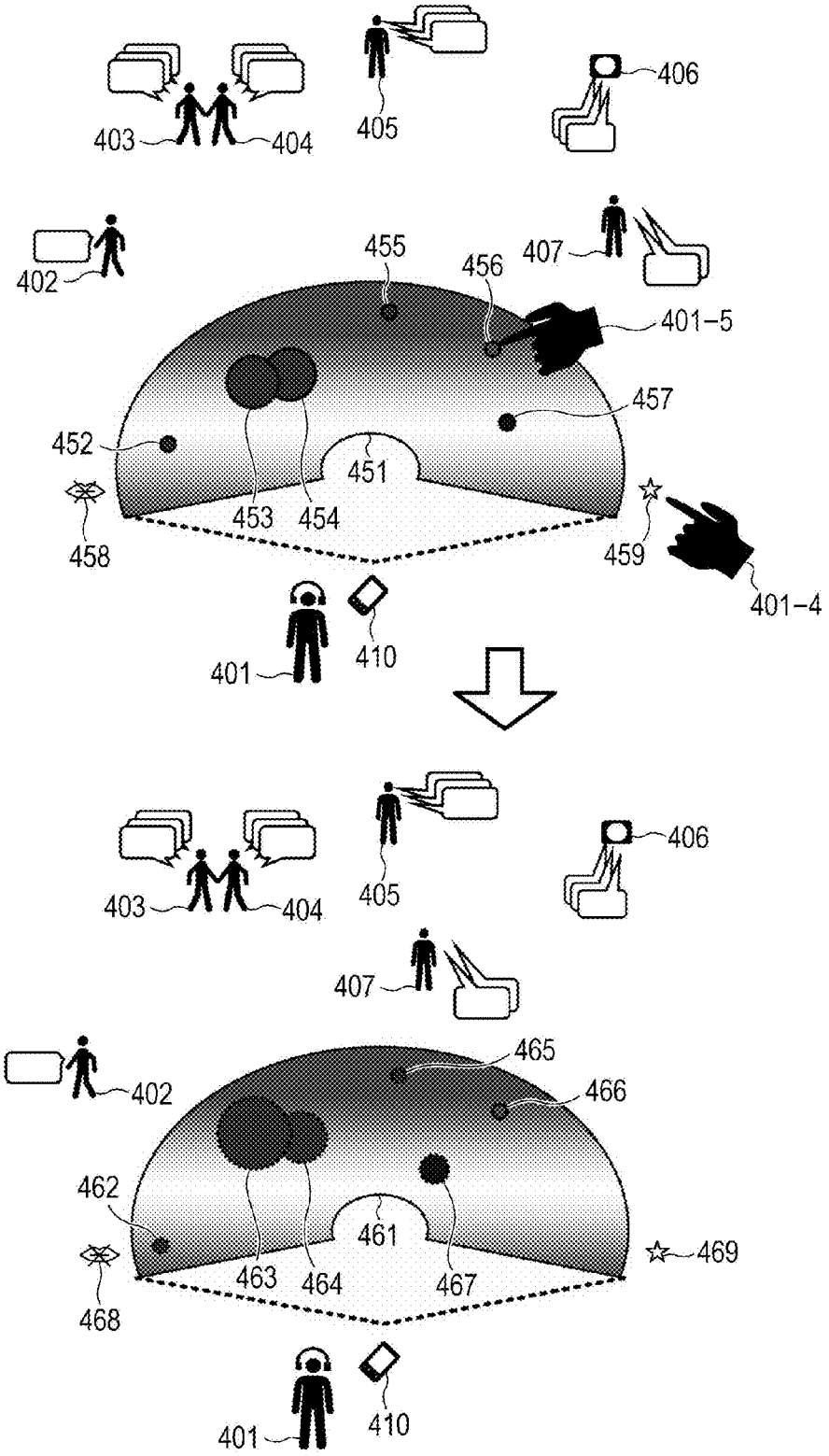
FIG. 4C shows an example in which only the speech of a particular speaker is selectively enhanced in the example of FIG. 4A according to an embodiment of the present invention.

FIG. 4C shows an example in which only the speech of a particular speaker is selectively enhanced in the example of FIG. 4A according to an embodiment of the present invention. The upper diagram of FIG. 4C is the same as the upper diagram of FIG. 4B.

Assume that the user 401 wants to enhance only the speech of a speaker associated with the group 456. The user 401 first touches an icon 459 with a finger 401-1. The user 401 next touches the area in the group 456 with a finger 401-5. The electronic system 410 receives the touches from the user 401 and can selectively enhance only the speech of the speaker associated with the group 456. The electronic system 210 can optionally automatically reduce or cancel the speech of the individual speakers associated with groups 452, 453, 454, 455, and 457 other than the group 456.

The lower diagram of FIG. 4C shows a screen 461 in which only the speech of a speaker associated with a group 466 (corresponding to the group 456) is selectively enhanced. The outlines of groups 462, 463, 464, 465, and 467 are displayed in dotted lines. In other words, the speech of speakers associated with the groups 462, 463, 464, 465, and 467 is automatically reduced or cancelled. The electronic system 410 can gradually increase the volume of the speech of the speaker associated with the group 466 as the number of touches in the area in the group 466 increases. Furthermore, the electronic system 410 can optionally gradually decrease the volumes of the speech of the speakers associated with the other groups 462, 463, 464, 465, and 467 as the volume of the speech of the speaker associated with the group 466 gradually increases to finally cancel the speech completely.

In the case where the user 401 wants to decrease the volume of the speech of the speaker associated with the group 466 again, the user 401 touches an icon 468 with a finger and next touches the area in the group 466.

Also, for the other groups 452, 453, 454, 455, or 457, by touching the icon 459 and thereafter touching the area in the group 452, 453, 454, 455, or 457 with a finger, the user 401 can enhance the speech of a speaker associated with the group touched.

In the upper diagram of FIG. 4C, by touching the icon 459 on the screen 451 and thereafter touching the area in the group 452, 453, 454, 455, 456, or 457, the speech of the speaker associated with the group 452, 453, 454, 455, 456, or 457 corresponding to the touched area can be selectively enhanced. Alternatively, by drawing, for example, a substantially circular shape (0), with a finger, on the area in the group 452, 453, 454, 455, 456, or 457, the user 401 can selectively enhance the speech of the speaker associated with the group in which the substantially circular shape (0) is drawn. This also applies to the screen 461. Alternatively, the electronic system 410 can switch between and enhancement and reduction/cancellation of speech by repeating touching in the area of the group 452, 453, 454, 455, 456, or 457.

Figure 5A:
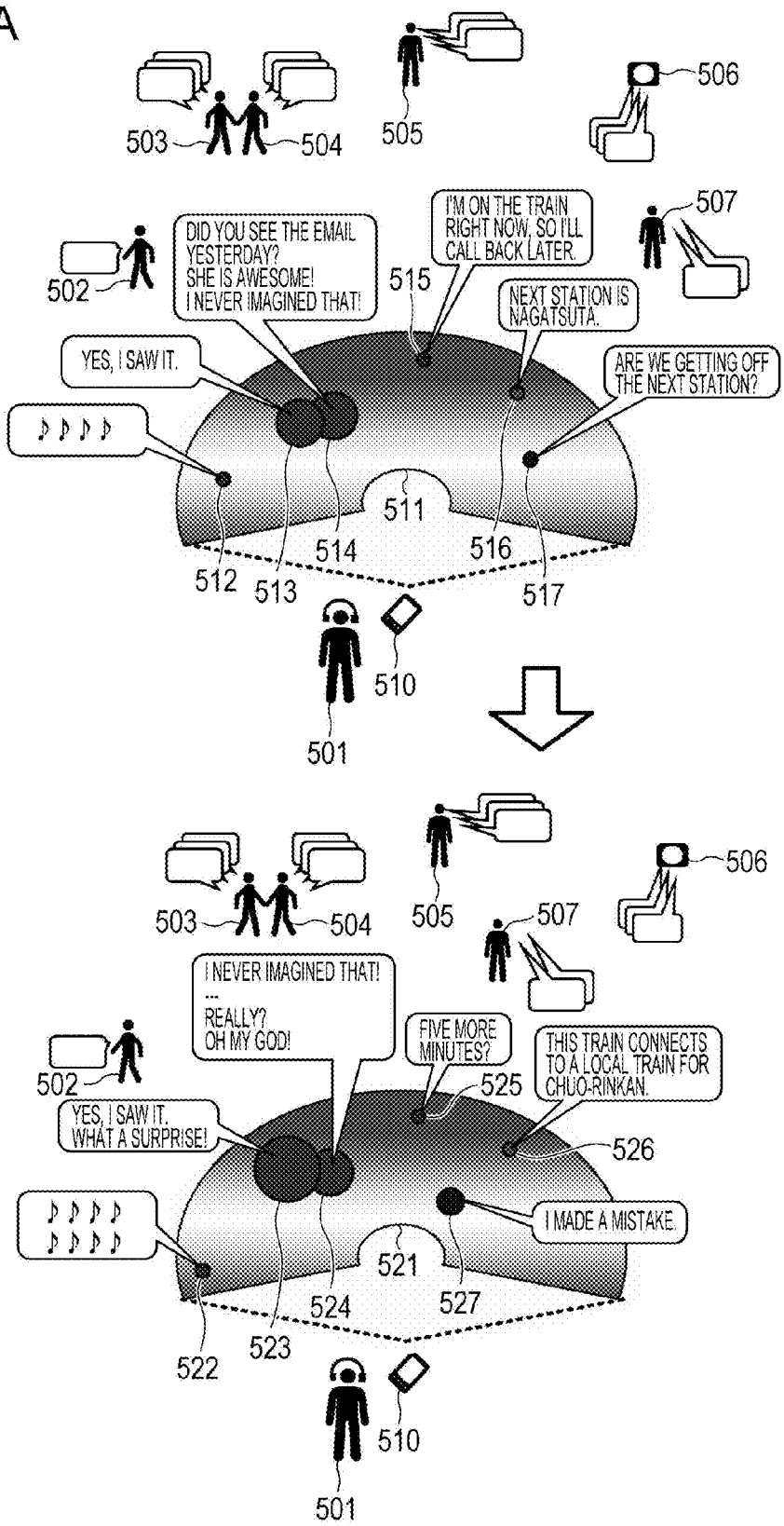
FIG. 5A shows an example of a user interface that groups text corresponding to speech depending on the feature of the speech and displays the text for the individual groups, which can be used in an embodiment of the present invention.

FIG. 5A shows an example of a user interface that groups text corresponding to speech depending on the feature of the speech and displays the text for the individual groups, which can be used in an embodiment of the present invention. FIG. 5A shows an example in a train according to an embodiment of the present invention. FIG. 5A shows a user 501 who carries an electronic system 510 according to the present invention and wears a headphone connected to the electronic system 510 by wire or wirelessly, persons 502, 503, 504, 505, and 507 around the user 501, and a loudspeaker 506 installed in the train. An announcement of a conductor of the train is broadcasted from the loudspeaker 506 installed in the train.

First, the upper diagram of FIG. 5A will be described. The user 501 touches an icon associated with a program according to the present invention, which is displayed on a screen 511 of a display installed in the electronic system 510, to start the program. The program causes the electronic system 510 to execute the operations described hereafter.

The electronic system 510 collects ambient sounds via a microphone attached to the electronic system 510. The electronic system 510 analyzes the collected sounds, extracts data associated with speech from the collected sounds, and extracts the features of the speech from the data. Subsequently, the electronic system 510 groups the speech by speech estimated to be generated from the same person on the basis of the extracted features. One group unit can correspond to one speaker. Accordingly, grouping speech can result in grouping speech by speakers. However, the automatic grouping made by the electronic system 510 is not always correct. In this case, the incorrect grouping can be corrected by the user 501 by using the grouping correction method described with reference to FIGS. 3A and 3B.

The electronic system 510 converts the grouped speech to text. The electronic system 510 can display the text corresponding to the speech on the display provided on the electronic system 510 in accordance with the grouping. Since a single group unit can correspond to a single speaker, as described above, text corresponding to the speech of a single speaker can be displayed in a single group unit. The electronic system 510 can display the grouped text in the individual groups in chronological order.

In FIG. 5A, the electronic system 510 groups the collected speech into six groups 512, 513, 514, 515, 516, and 517. The electronic system 510 can display the individual groups 512, 513, 514, 515, 516, and 517, on the display, at positions close to directions in which persons associated with the individual groups 512, 513, 514, 515, 516, and 517 (that is, speech sources) are present or so as to correspond to the directions and the relative distances between the user 501 and the individual groups 512, 513, 514, 515, 516, and 517 (the circles in FIG. 5A correspond to the individual groups 512, 513, 514, 515, 516, and 517). The groups 512, 513, 514, 515, and 517 correspond to (or are associated with) the persons 502, 503, 504, 505, and 507, and the group 516 corresponds to (or is associated with) the loudspeaker 506. The display can be expressed as, for example, icons indicating speakers, for example, circular icons.

The electronic system 510 displays text corresponding to the speech in chronological order in balloons coming from the groups 512, 513, 514, 515, 516, and 517. The electronic system 510 can display the balloons coming from the individual groups in the vicinity of the circles indicating the groups.

Next, the lower diagram of FIG. 5A will be described. Subsequently, the electronic system 510 further collects ambient sounds via the microphone. The electronic system 510 analyzes the collected sounds, extracts data associated with speech from the collected sounds, and newly extracts the features of the speech from the data. The electronic system 510 groups the speech on the basis of the newly extracted features by speech estimated to be generated from the same person. The electronic system 510 identifies, among the groups 512, 513, 514, 515, 516, and 517, groups that the grouped speech belongs to on the basis of the newly extracted features. Alternatively, the electronic system 510 may identify groups that the speech belongs to, on the basis of the newly extracted features, without grouping the speech into the groups 512, 513, 514, 515, 516, and 517. The electronic system 510 converts the grouped speech to text.

In the case where persons 502, 503, 504, 505, and 507 move with time, the electronic system 510 can move the display positions of the individual groups 512, 513, 514, 515, and 517 so as to display the individual groups 512, 513, 514, 515, and 517, on the display, at positions close to directions in which the persons 502, 503, 504, 505, and 507 associated with the individual groups 512, 513, 514, 515, and 517 (that is, speech sources) have moved or the directions and the relative distances between the user 501 and individual groups 512, 513, 514, 515, and 517 and can display the individual groups 512, 513, 514, 515, and 517 again (see, a screen 521). Furthermore, in the case where the user 501 moves with time, the electronic system 510 can move the display positions of the individual groups 512, 513, 514, 515, 517, and 516 so as to display the individual groups 512, 513, 514, 515, 517, and 516, on the display, in the directions in which the persons 502, 503, 504, 505, and 507 and the loudspeaker 506 are viewed from the user 501 or the directions and the relative distance between the user 501 and individual groups 512, 513, 514, 515, 517, and 516 and can display the individual groups 512, 513, 514, 515, 517, and 516 again (see, the screen 521). The lower diagram of FIG. 5A shows the positions after the regeneration with circles 522, 523, 524, 525, 526, and 527.

The electronic system 510 can display the text in chronological order in the balloons coming from regenerated groups 522, 523, 524, 525, 527, and 526. The electronic system 510 can make the text displayed in the balloons coming from the individual groups 512, 513, 514, 515, 517, and 516 in the upper diagram of FIG. 5A visible/invisible on the screen in ascending order by time to display the latest text. The user 501 can view hidden text by touching, for example, up-pointing triangular icons (not shown) displayed in the individual groups 512, 513, 514, 515, 516, and 517. Alternatively, the user 501 can view hidden text by swiping his/her finger upwards in the individual groups 512, 513, 514, 515, 516, and 517. The user 501 can view the latest text by touching, for example, down-pointing triangular icons (not shown) displayed in the individual groups 512, 513, 514, 515, 516, and 517. Alternatively, the user 501 can view the latest text by swiping his/her finger downwards in the individual groups 512, 513, 514, 515, 516, and 517.

Figure 5B:
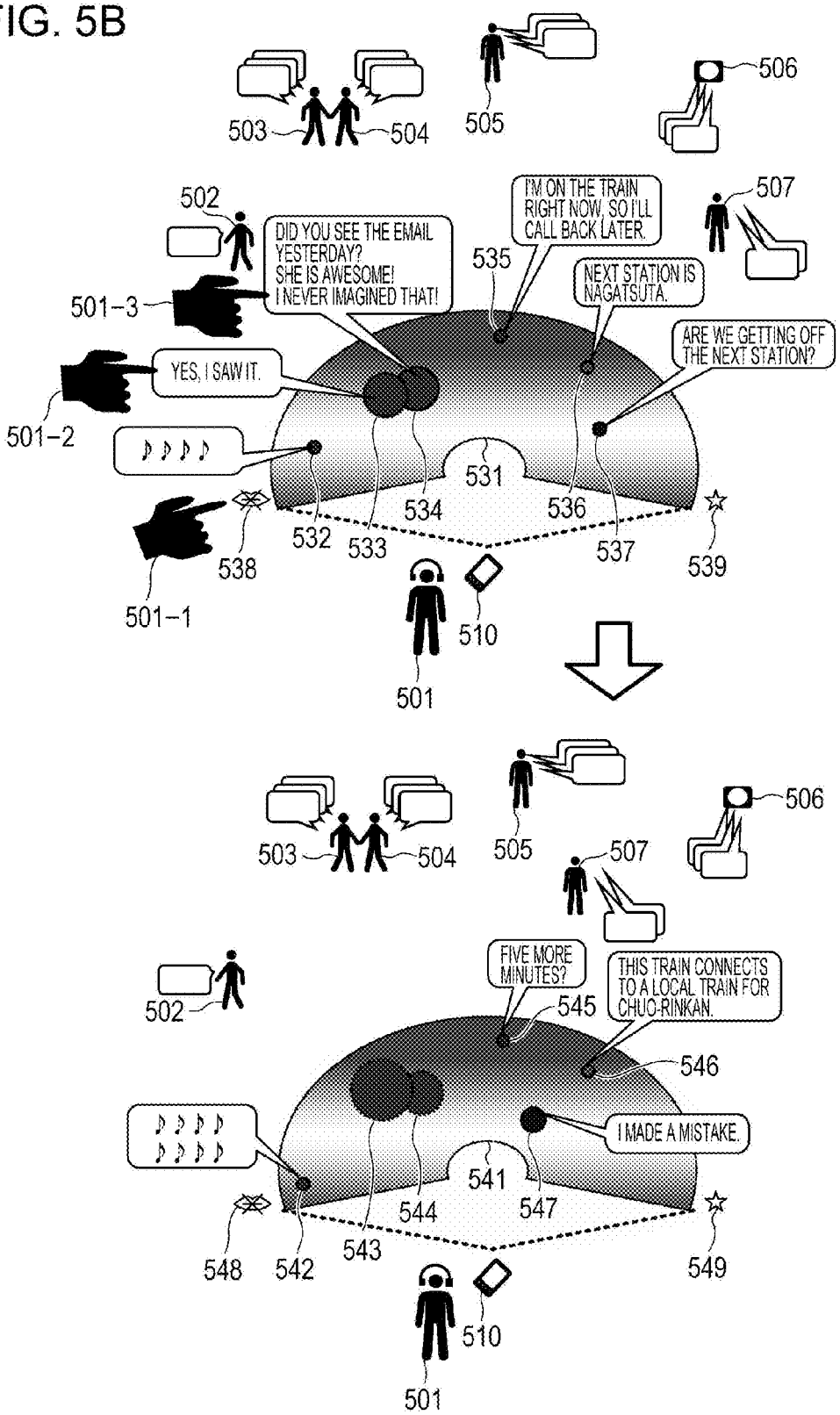
FIG. 5B shows an example in which only the speech of a particular speaker is selectively reduced or cancelled in the example of FIG. 5A according to an embodiment of the present invention.

FIG. 5B shows an example in which only the speech of a particular speaker is selectively reduced or cancelled in the example of FIG. 5A according to an embodiment of the present invention. The upper diagram of FIG. 5B is the same as the upper diagram of FIG. 5A, except that an icon 538 in a lip shape with X is displayed at the lower left corner of the screen 531 and a star-shaped icon 539 is displayed at the lower right corner of the screen 531. The icon 538 is used to reduce or cancel, via the headphone, the speech of a speaker associated with a group touched by the user 501 from among the groups 532, 533, 534, 535, 536, and 537 displayed on the screen 531. The icon 539 is used to enhance, via the headphone, all the speech of a speaker associated with a group touched by the user 501 from among the groups 532, 533, 534, 535, 536, and 537 displayed on the screen 531.

Assume that the user 501 wants to reduce or cancel only the speech of two speakers associated with the groups 533 and 534. The user 501 first touches the icon 538 with a finger 501-1. Next, the user 501 touches the area in the group 533 with a finger 501-2 and next touches the area in the group 534 with a finger 501-3. The electronic system 510 receives the touches from the user 501 and can selectively reduce or cancel only the speech of the speakers associated with the groups 533 and 534.

The lower diagram of FIG. 5B shows a screen 541 in which only the speech of the speakers associated with groups 543 and 544 (corresponding to the groups 533 and 534, respectively) is selectively reduced. The outlines of the groups 543 and 544 are shown by dotted lines. The balloons coming from the groups 533 and 534 are eliminated in the groups 543 and 544. The electronic system 510 can gradually decrease the volume of the speech of the speaker associated with the group 543 as the number of touches in the area of the group 543 increases to finally cancel the speech completely. Likewise, the electronic system 510 can gradually decrease the volume of the speech of the speaker associated with the group 544 as the number of touches in the area of the group 544 increases to finally cancel the speech completely.

In the case where the user 501 wants to increase the volume of the speech of the speaker associated with the group 543 again, the user 501 touches an icon 549 with a finger and next touches the area in the group 543. Likewise, in the case where the user 501 wants to increase the volume of the speech of the speaker associated with the group 544 again, the user 501 touches the icon 549 with a finger and next touches the area in the group 544.

Also for the other group 532, 535, 536, or 537, by touching the icon 538 and thereafter touching the area in the group 532, 535, 536, or 537 with a finger, the user 501 can reduce or cancel the speech of the speaker associated with a group corresponding to the touched area.

In the upper diagram of FIG. 5B, by touching the icon 538 and thereafter touching the area in the group 532, 533, 534, 535, 536, or 537 on the screen 531, the user 501 can selectively reduce or cancel the speech of a speaker associated with the group 532, 533, 534, 535, 536, or 537 corresponding to the area touched. Alternatively, by drawing, for example, X, with a finger on the area in the group 532, 533, 534, 535, 536, or 537, the user 501 can selectively reduce or cancel the speech of a speaker associated with the group in which the X mark is drawn. This also applies to the screen 541. Alternatively, by repeating touching in the area of the group 532, 533, 534, 535, 536, or 537, the electronic system 510 can switch between reduction/cancellation and enhancement of speech in the same group.

Figure 5C:
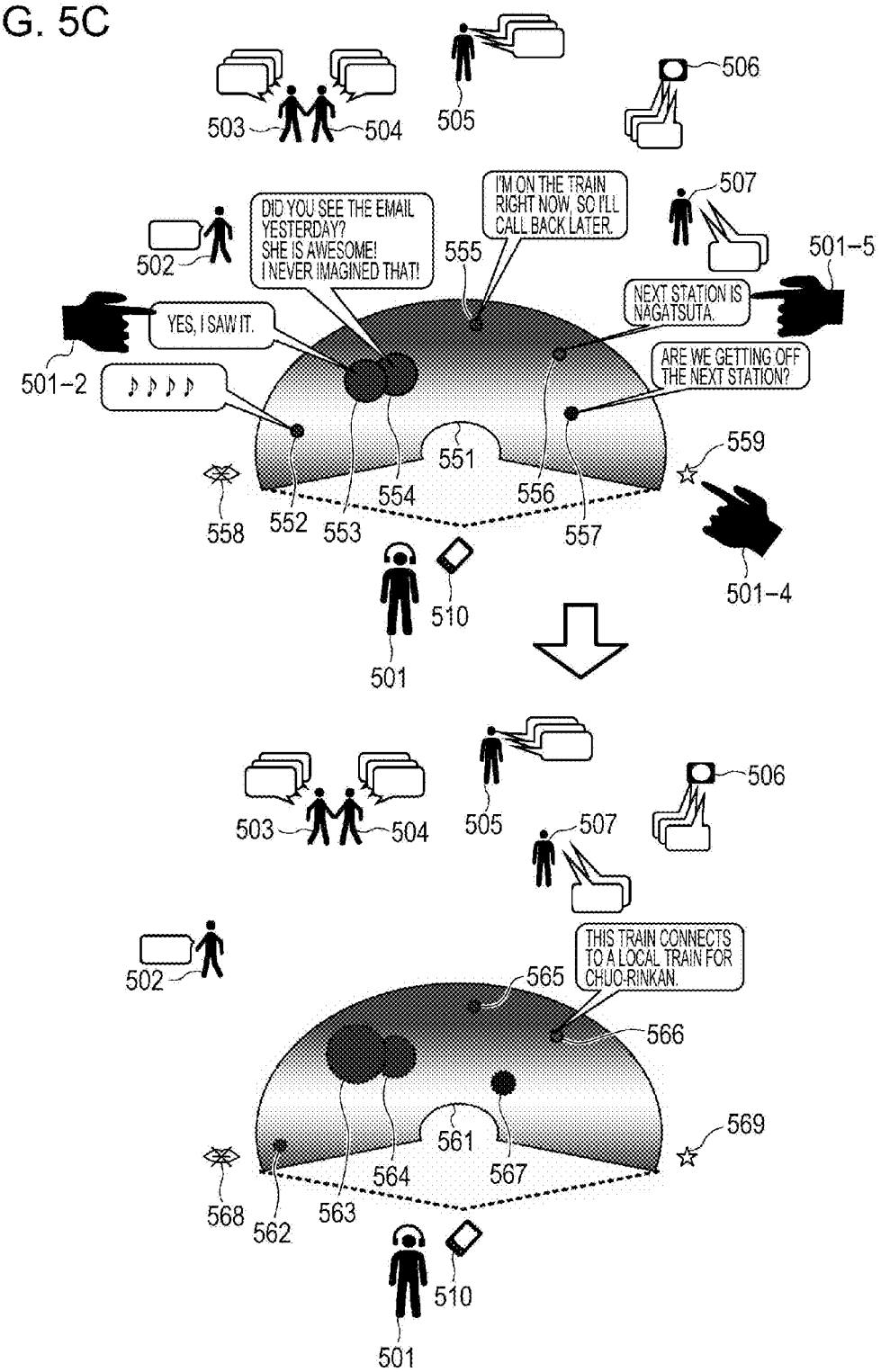
FIG. 5C shows an example in which only the speech of a particular speaker is selectively enhanced in the example of FIG. 5A according to an embodiment of the present invention.

FIG. 5C shows an example in which only the speech of a particular speaker is selectively enhanced in the example of FIG. 5A according to an embodiment of the present invention. The upper diagram of FIG. 5C is the same as the upper diagram of FIG. 5B.

Assume that the user 501 wants to enhance only the speech of a speaker associated with the group 556. The user 501 first touches an icon 559 with a finger 501-4. The user 501 next touches the area in the group 556 with a finger 501-5. The electronic system 510 receives the touches from the user 501 and can selectively enhance only the speech of the speaker associated with the group 556. The electronic system 510 can optionally automatically reduce or cancel the speech of the individual speakers associated with groups 552, 553, 554, 555, and 557 other than the group 556.

The lower diagram of FIG. 5C shows a screen 561 in which only the speech of a speaker associated with a group 566 (corresponding to the group 556) is selectively enhanced. The outlines of groups 562, 563, 564, 565, and 567 are displayed in dotted lines. In other words, the speech of speakers associated with the groups 562, 563, 564, 565, and 567 is automatically reduced or cancelled. The electronic system 510 can gradually increase the volume of the speech of the speaker associated with the group 566 as the number of touches in the area in the group 566 increases. Furthermore, the electronic system 510 can optionally gradually decrease the volumes of the speech of the speakers associated with the other groups 562, 563, 564, 565, and 567 as the volume of the speech of the speaker associated with the group 566 gradually increases to finally cancel the speech completely.

In the case where the user 501 wants to decrease the volume of the speech of the speaker associated with the group 566 again, the user 501 touches an icon 568 with a finger and next touches the area in the group 566.

Also, for the other groups 552, 553, 554, 555, or 557, by touching the icon 559 and thereafter touching the area in the group 552, 553, 554, 555, or 557 with a finger, the user 501 can enhance the speech of a speaker associated with the group touched.

In the upper diagram of FIG. 5C, by touching the icon 559 on the screen 551 and thereafter touching the area in the group 552, 553, 554, 555, 556, or 557, the speech of the speaker associated with the group 552, 553, 554, 555, 556, or 557 corresponding to the touched area can be selectively enhanced. Alternatively, by drawing, for example, a substantially circular shape, with a finger, on the area in the group 552, 553, 554, 555, 556, or 557, the user 501 can selectively enhance the speech of the speaker associated with the group in which the substantially circular shape is drawn. This also applies to the screen 561. Alternatively, the electronic system 510 can switch between and enhancement and reduction/cancellation of speech by repeating touching in the area of the group 552, 553, 554, 555, 556, or 557.

Figure 6A:
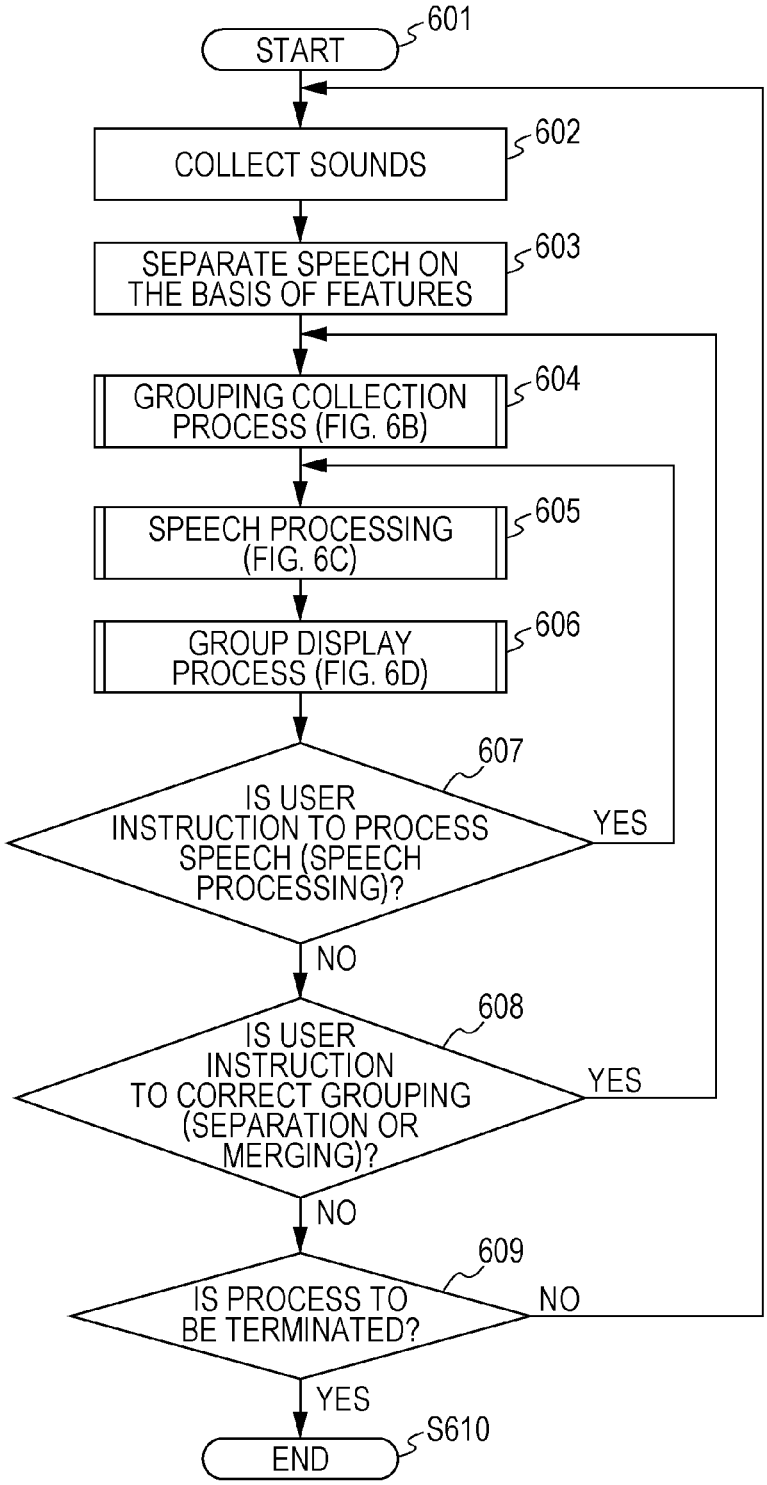
FIG. 6A shows a main flowchart for processing the speech of a particular speaker according to an embodiment of the present invention.

FIGS. 6A to 6D show flowcharts for processing the speech of a particular speaker according to an embodiment of the present invention. FIG. 6A shows a main flowchart for processing the speech of a particular speaker.

In step 601, the electronic system 101 starts to process the speech of a particular speaker according to an embodiment of the present invention. In step 602, the electronic system 101 collects sounds via a microphone provided in the electronic system 101. An example of the sounds can be the voice of a person who is speaking intermittently. In an embodiment of the present invention, the electronic system 101 collects sounds including speech. The electronic system 101 can record data of the collected speech in the main memory 103 or the disk 108.

The electronic system 101 can identify an individual from the feature of the voice of the speaker (any unspecified person, i.e. the speaker does not need to be registered in advance). The technique is known to those skilled in the art; in an embodiment of the present invention, for example, AmiVoice® by Advanced Media, Inc. may be used to implement this technique.

Even if there are a plurality of speakers, and they are moving, the electronic system 101 can specify and continuously track the direction in which the speech of the speakers is generated. The technique for specifying and continuously tracking the directions in which the speech of the speakers is generated is known to those skilled in the art. For example, the mechanisms described in Japanese Unexamined Patent Application Publication No. 2008-87140 and/or Shoji Makino et. al, "Blind separation of audio signals", NTT Technical Journal, vol. 15, no. 12, pp. 8-12, December 2003, available from are examples of mechanisms that may be used to implement this technique. Japanese Unexamined Patent Application Publication No. 2008-87140 discloses a technique for a speech recognition robot that is capable of responding to a speaker in a state in which it faces the speaker all the time. Shoji Makino et. al, describes real-time speech source separation for separating and reproducing speech while tracking moving speakers by performing blind speech source separation based on an independent component analysis.

In step 603, the electronic system 101 analyzes the sounds collected in step 602 and extracts the features of the individual sounds. In an embodiment of the present invention, the electronic system 101 separates human speech from the sounds collected in step 602, analyzes the separated speech, and extracts the features of the individual speech (that is, the features of the individual speakers). The extraction of features can be executed using, for example, a speaker verification technique that is known to those skilled in the art. The electronic system 101 can store the extracted features in, for example, feature storage means (see FIG. 8). Next, the electronic system 101 separates the collected speech by speech estimated to be generated from the same person to group the separated speech on the basis of the extracted features. Accordingly, the grouped speech can each correspond to the speech of a single speaker. The electronic system 101 can display, in one group, the speech of the speaker associated with the group in a temporal sequence.

Figure 6B:
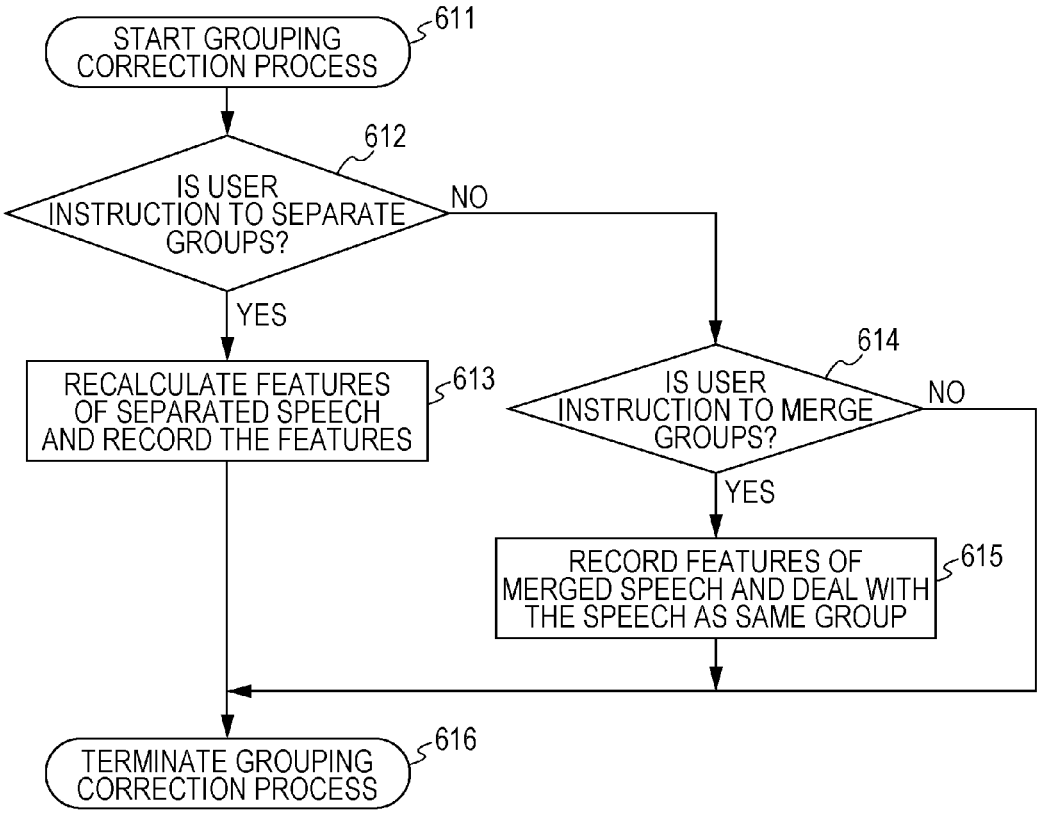
FIG. 6B is a flowchart for the details of a grouping correction process of the steps in the flowchart shown in FIG. 6A.

In step 604, the electronic system 101 goes to the next step 605 via step 611, step 612 (No), step 614 (No), and step 616, as shown in FIG. 6B (grouping correction process) showing the details of step 604, until the groups are displayed on the screen of the electronic system 101. In other words, the electronic system 101 passes step 604 without substantially executing anything other than the determination processes in step 612 and step 614 shown in FIG. 6B. The grouping correction process will be separately described in detail below with reference to FIG. 6B.

Figure 6C:
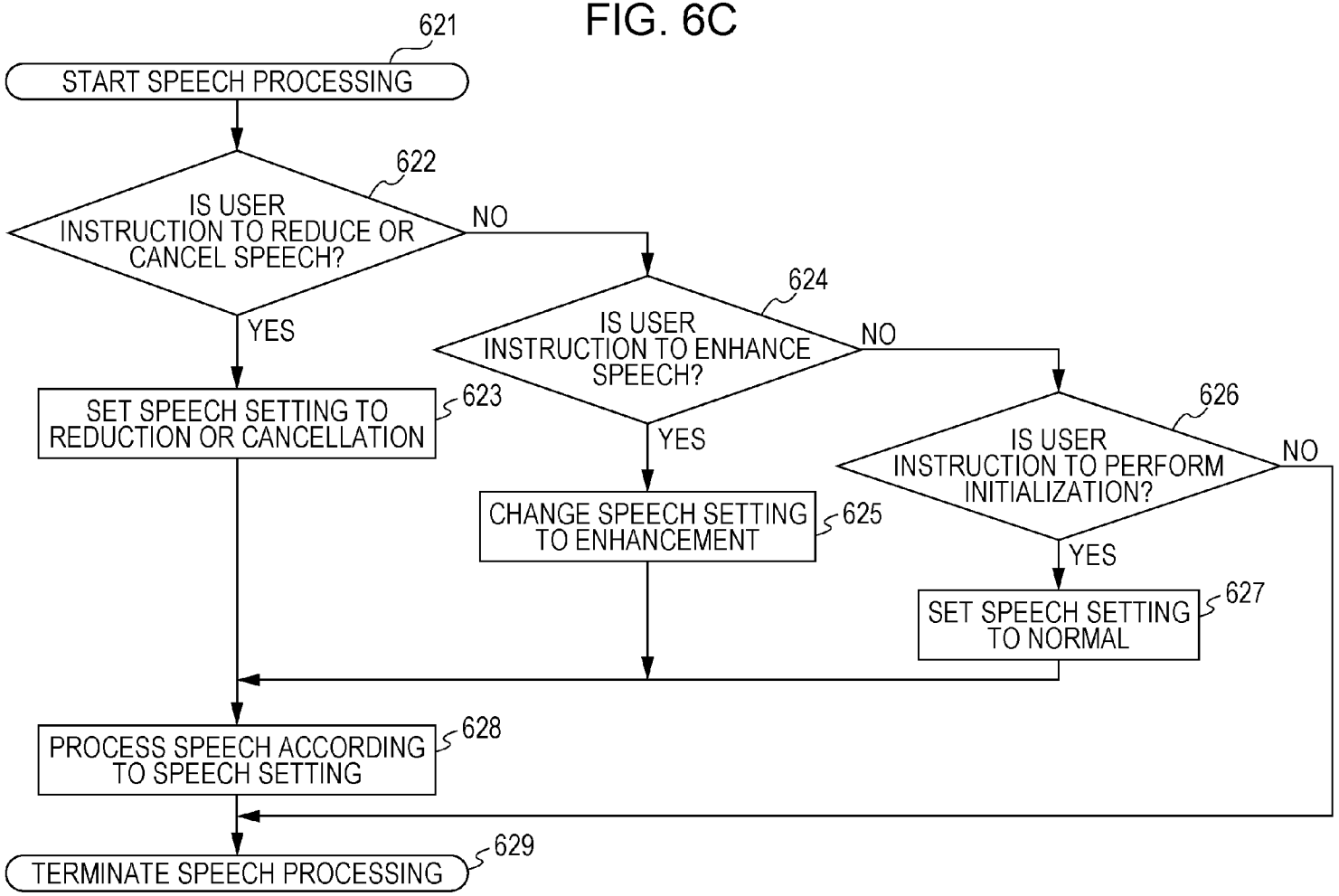
FIG. 6C is a flowchart for the details of a speech processing operation of the steps in the flowchart shown in FIG. 6A.

In step 605, the electronic system 101 executes step 621, step 622 (No), step 624 (No), step 626 (Yes), step 627, step 628, and step 629, as shown in FIG. 6C (speech processing) showing the details of step 604, until the groups are displayed on the screen of the electronic system 101. Specifically, in step 605, the electronic system 101 sets speech settings for the individual groups obtained in step 603 to "normal" (that is, any of an enhancing process and a reducing/cancelling process is not performed) (see step 626 in FIG. 6C). In an embodiment of the present invention, the speech settings include "normal", "enhancement", and "reduction/cancellation". If the speech setting is "normal", the speech of a speaker associated with the group that is set to "normal" is not processed. If the speech setting is "enhancement", the speech of a speaker associated with the group that is set to "enhancement" is enhanced. If the speech setting is "reduction/cancellation", the speech of a speaker associated with the group that is set to "reduction/cancellation" is reduced or cancelled. Thus, the speech setting can be made for the individual groups so that the electronic system 101 can determined how to process the speech associated with the individual groups. The speech processing will be separately described in detail below with reference to FIG. 6C.

In step 606, the electronic system 101 can visually display the groups on the screen thereof. The electronic system 101 can display the groups with icons (see FIGS. 4A to 4C and FIGS. 5A to 5C). Alternatively, the electronic system 101 can display text corresponding to speech that belongs to the groups in the form of, for example, balloons (see FIGS. 2A to 2C). The electronic system 101 can optionally display the text of the speech of speakers associated with the groups in association with the groups. The group display process will be separately described in detail below with reference to FIG. 6D.

In step 607, the electronic system 101 receives an instruction from the user. The electronic system 101 determines whether the user instruction is to process the speech, that is, enhancement or reduction/cancellation of speech. If the user instruction is to process the speech, the electronic system 101 returns the process to step 605. If the user instruction is not to process the speech, the electronic system 101 advances the process to step 608. In step 605, in response to that the user instruction is to process the speech, the electronic system 101 enhances or reduces/cancels the speech that belongs to the group to be processed. The speech processing will be separately described in detail below with reference to FIG. 6C, as described above.

In step 608, the electronic system 101 determines whether the user instruction received in step 607 is to correct grouping, that is, separation or merging of groups. If the user instruction is to correct grouping, that is, separation or merging, the electronic system 101 returns the process to step 604. If the user instruction is not to correct grouping, the electronic system 101 advances the process to step 609. In response to that the process returns to step 604, if the user instruction is to separate the group, the electronic system 101 separates the group into two groups (see the example in FIG. 3A), and if the user instruction is to merge the groups, the electronic system 101 merges at least two groups to one group (see the example in FIG. 3B). The grouping correction process will be described in detail below with reference to FIG. 6B, as described above.

In step 609, the electronic system 101 determines whether to terminate the process of processing the particular speech. The determination whether to terminate the process can be made, for example, when an application that implements a computer program according to an embodiment of the present invention has ended. If the process is to be terminated, the electronic system 101 advances the process to the termination step 610. If the process is to be continued, the electronic system 101 returns the process to step 602 to continue collection of speech. The electronic system 101 performs the processes from step 602 to 606 also while the processes from step 607 to 609 are being performed. In step 610, the electronic system 101 terminates the process of processing the speech of the particular speaker according to an embodiment of the present invention.

FIG. 6B is a flowchart for the details of step 604 (grouping correction process) of the flowchart shown in FIG. 6A. In step 611, the electronic system 101 starts the speech-grouping correction process. In step 612, the electronic system 101 determines whether the user instruction received in step 607 is a group separation operation. If the user instruction is a group separation operation, the electronic system 101 advances the process to step 613. If the user instruction is not a group separation operation, the electronic system 101 advances the process to step 614.

In step 613, in response to the user instruction being a group separation operation, the electronic system 101 can recalculate the features of the speech of the separated groups and can record the recalculated features in the main memory 103 or the disk 108 in the electronic system 101. The recalculated features are used for the following grouping. In accordance with the separation process, the electronic system 101 can display the groups on the screen again in step 606 on the basis of the separation. In other words, the electronic system 101 can correctly separate a group that is regarded as a single group by mistake into two groups and can display them.

In step 614, the electronic system 101 determines whether the user instruction received in step 607 is an operation of merging at least two groups. If the user instruction is a merging operation, the electronic system 101 advances the process to step 615. If the user instruction is not a merging operation, the electronic system 101 advances the process to step 616 which is a grouping-correction-process termination step.

In step 615, in response to the user instruction being a merging operation, the electronic system 101 merges at least two groups identified by the user. In the following steps, the electronic system 101 deals with speech having the features of the merged groups as a single group. In other words, the electronic system 101 deals with speech having the individual features of the two groups as belonging to the merged single group. Alternatively, the electronic system 101 can extract features common to the at least two merged groups and can record the extracted common features in the main memory 103 or the disk 108 in the electronic system 101. The extracted common features can be used for the subsequent grouping. In step 616, the electronic system 101 terminates the speech-grouping correction process and advances the process to step 605 shown in FIG. 6A.

FIG. 6C is a flowchart for the details of step 605 (speech processing operation) of the flowchart shown in FIG. 6A. In step 621, the electronic system 101 starts the speech processing operation. In step 622, the electronic system 101 determines whether the user instruction received in step 607 is to reduce or cancel speech in the group selected by the user. If the user instruction is to reduce or cancel the speech, the electronic system 101 advances the process to step 623. If the user instruction is not to reduce or cancel the speech, the electronic system 101 advances the process to step 624.

In step 623, in response to the user instruction being to reduce or cancel the speech, the electronic system 101 changes the speech setting for the group to reduction or cancellation. The electronic system 101 can optionally change the speech settings for groups other than the group to enhancement.

In step 624, the electronic system 101 determines whether the user instruction received in step 607 is to enhance the speech in the group selected by the user. If the user instruction is to enhance the speech, the electronic system 101 advances the process to step 625. If the user instruction is not to enhance the speech, the electronic system 101 advances the process to step 626.

In step 625, in response to the user instruction being enhancement, the electronic system 101 changes the speech setting for the group to enhancement. The electronic system 101 can optionally change the speech settings for groups other than the group to reduction or cancellation.

In step 626, the electronic system 101 determines whether to initialize the speech of the speakers associated with the individual groups of the speech collected in step 602 and separated on the basis of their features in step 603. Alternatively, the electronic system 101 may determine whether to initialize the speech of a speaker associated with a group selected by the user in accordance with a received user instruction. If initialization is to be performed, the electronic system 101 advances the process to step 627. If initialization is not to be performed, the electronic system 101 advances the process to step 629.

In step 627, the electronic system 101 sets the speech settings for the individual groups obtained in step 603 to "normal" (that is, any of enhancement and reduction/cancellation is not performed). If the speech settings are "normal", speech processing is not performed.

In step 628, the electronic system 101 processes the speech of the speakers associated with the individual groups in accordance with the speech settings for the individual groups. Specifically, the electronic system 101 reduces/cancels or enhances the speech of the speakers associated with the individual groups. The processed speech is output from speech-signal output means 810 of the electronic system 101, such as a headphone, an earphone, a hearing aid, or a loudspeaker. In step 629, the electronic system 101 terminates the speech processing operation.

Figure 6D:
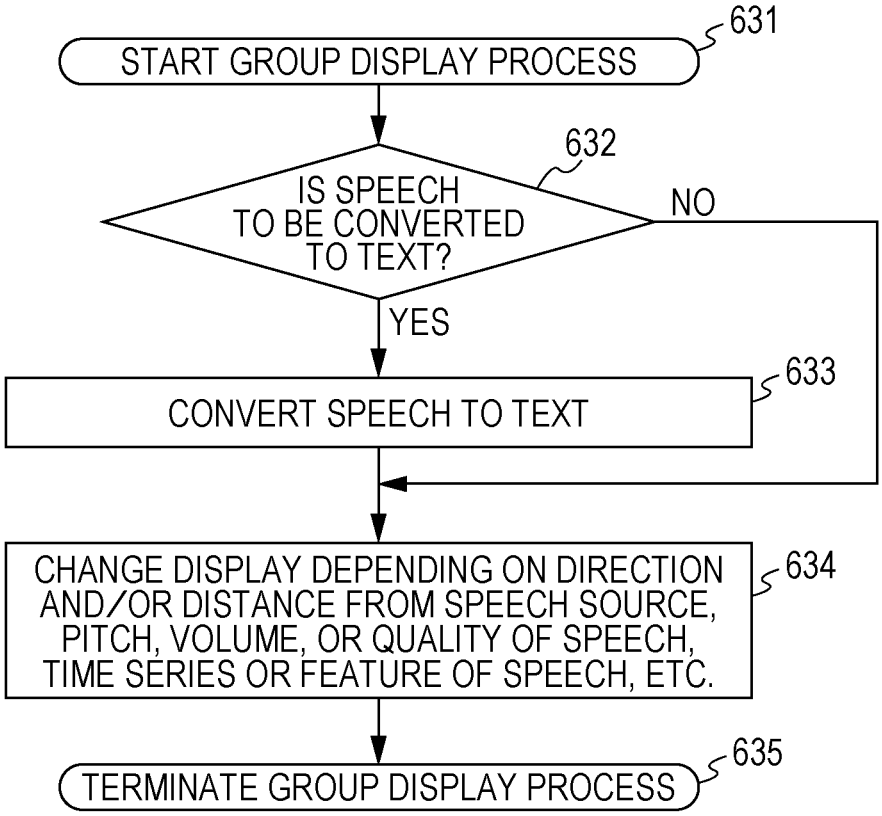
FIG. 6D shows a flowchart for the details of a group display process of the steps in the flowchart shown in FIG. 6A.

FIG. 6D shows a flowchart for the details of step 606 (group display process) of the flowchart shown in FIG. 6A. In step 631, the electronic system 101 starts the group display process. In step 632, the electronic system 101 determines whether to convert speech to text. If the speech is to be converted to text, the electronic system 101 advances the process to step 633. If the speech is not to be converted to text, the electronic system 101 advances the process to step 634.

In step 633, in response to the speech needing to be converted to text, the electronic system 101 can display text corresponding to the speech in chronological order in the individual groups on the screen (see FIGS. 2A and 5A). Furthermore, the electronic system 101 can optionally dynamically change the display of the text depending on the directions and/or distance of the speech sources, the pitches, volumes, or qualities of the sounds, the time series or the features of the speech.

In step 634, in response to the speech not needing to be converted to text, the electronic system 101 can display icons indicating the individual groups on the screen (see FIG. 4A). Furthermore, the electronic system 101 can optionally dynamically change the display of the icons indicating the individual groups depending on the directions and/or distances of the speech sources, the pitches, volumes, or qualities of the sounds, the time series or the features of the speech. In step 635, the electronic system 101 terminates the group display process and advances the process to step 607 shown in FIG. 6A.

Figure 7A:
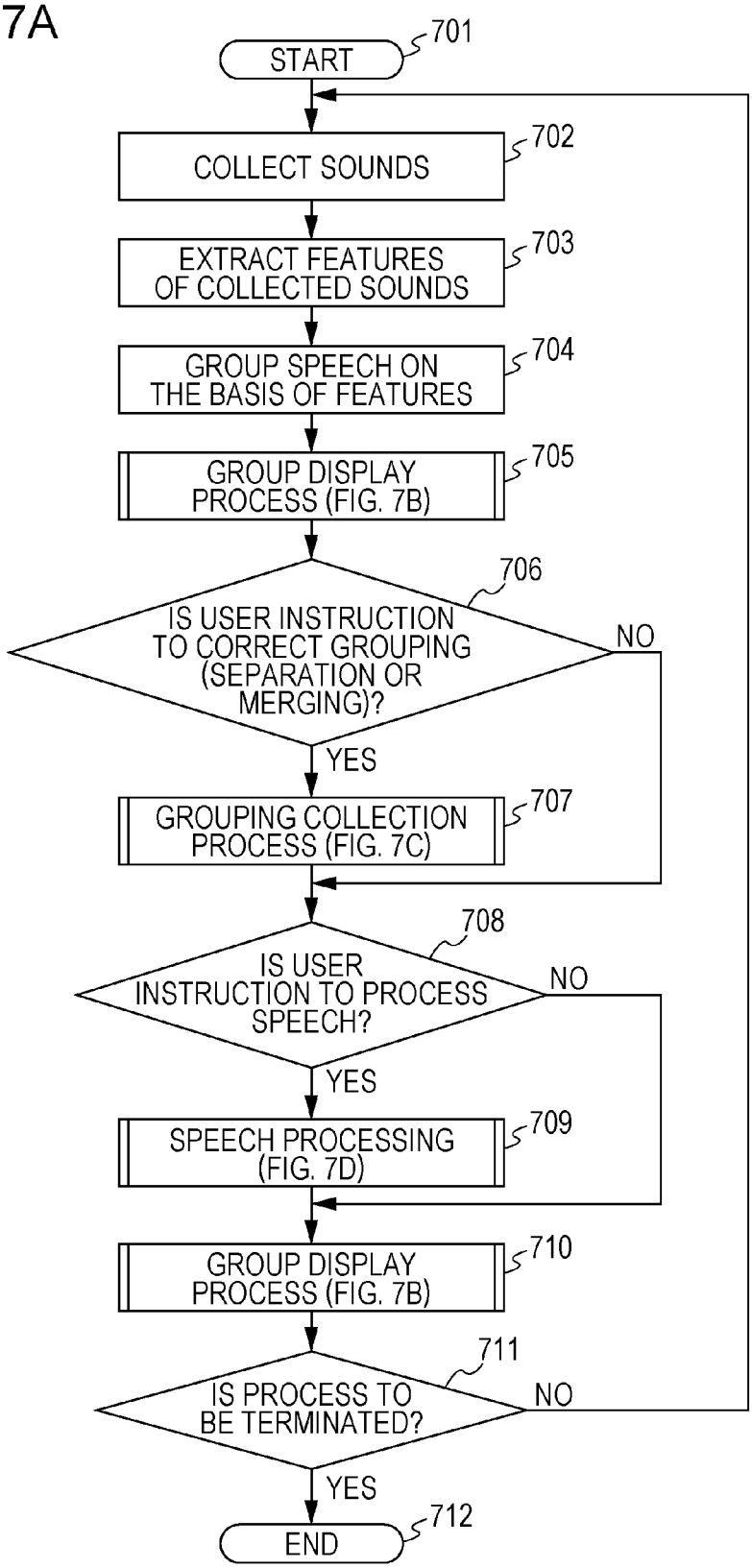
FIG. 7A shows a main flowchart for processing the speech of a particular speaker according to an embodiment of the present invention.

FIGS. 7A to 7D show flowcharts for processing the speech of a particular speaker according to an embodiment of the present invention. FIG. 7A shows a main flowchart for processing the speech of a particular speaker. As shown in FIG. 7A, in step 701, the electronic system 101 starts to process the speech of a particular speaker according to an embodiment of the present invention. In step 702, as in step 602 of FIG. 6A, the electronic system 101 collects sounds via the microphone provided in the electronic system 101. The electronic system 101 can record data of the collected sounds in the main memory 103 or the disk 108.

In step 703, as in step 603 of FIG. 6A, the electronic system 101 analyzes the speech collected in step 702 and extracts the features of the individual speech. In step 704, the electronic system 101 groups the collected speech by speech estimated to be generated from the same person on the basis of the features extracted in step 703. Accordingly, the grouped speech can each correspond to the speech of a single speaker.

In step 705, the electronic system 101 can visually display the groups on the screen of the electronic system 101 in accordance with the grouping in step 704. The electronic system 101 can display the groups with icons, for example (see FIGS. 4A to 4C and FIGS. 5A to 5C). Alternatively, the electronic system 101 can display text corresponding to speech that belongs to the groups in the form of balloons, for example (see FIGS. 2A to 2C). The electronic system 101 can optionally display the text of the speech of speakers associated with the groups in association with the groups. The group display process will be separately described in detail below with reference to FIG. 7B.

In step 706, the electronic system 101 receives an instruction from the user. The electronic system 101 determines whether the user instruction is to correct the grouping, that is, separation or merging of groups. If the user instruction is to correct the grouping, separation or merging, the electronic system 101 advances the process to step 707. If the user instruction is not to correct the grouping, separation or merging, the electronic system 101 advances the process to step 708.

If the user instruction received in step 706 is to separate the group, the electronic system 101 separates the group into two in step 707 (see the example of FIG. 3A). If the user instruction is to merge groups, the electronic system 101 merges at least two groups to one group (see the example of FIG. 3B). The grouping correction process will be separately described in detail below with reference to FIG. 7C.

In step 708, the electronic system 101 determines whether the user instruction received in step 706 is to process the speech, that is, enhancement or reduction/cancellation of speech. If the user instruction is to process the speech, the electronic system 101 advances the process to step 709. If the user instruction is not to process the speech, the electronic system 101 advances the process to step 710.

In step 709, in response to that the user instruction is to process the speech, the electronic system 101 enhances or reduces/cancels the speech of the speaker associated with the specified group. The speech processing operation will be separately described in detail below with reference to FIG. 7D.

In step 710, the electronic system 101 can visually display the latest or updated group on the screen of the electronic system 101 again in accordance with the user instruction in step 706 and the user instruction in step 708. The electronic system 101 can optionally display the latest text of the speech of the speaker associated with the latest or updated group in the group or in association with the group. The group display process will be separately described in detail below with reference to FIG. 7B.

In step 711, the electronic system 101 determines whether to terminate the process of processing the speech of the particular speaker. If the process is to be terminated, the electronic system 101 advances the process to the termination step 712. If the process is to be continued, the electronic system 101 returns the process to step 702 to continue collection of speech. The electronic system 101 performs the processes from step 702 to 705 also while the processes from step 706 to 711 are being performed. In step 712, the electronic system 101 terminates the process of processing the speech of the particular speaker according to an embodiment of the present invention.

Figure 7B:
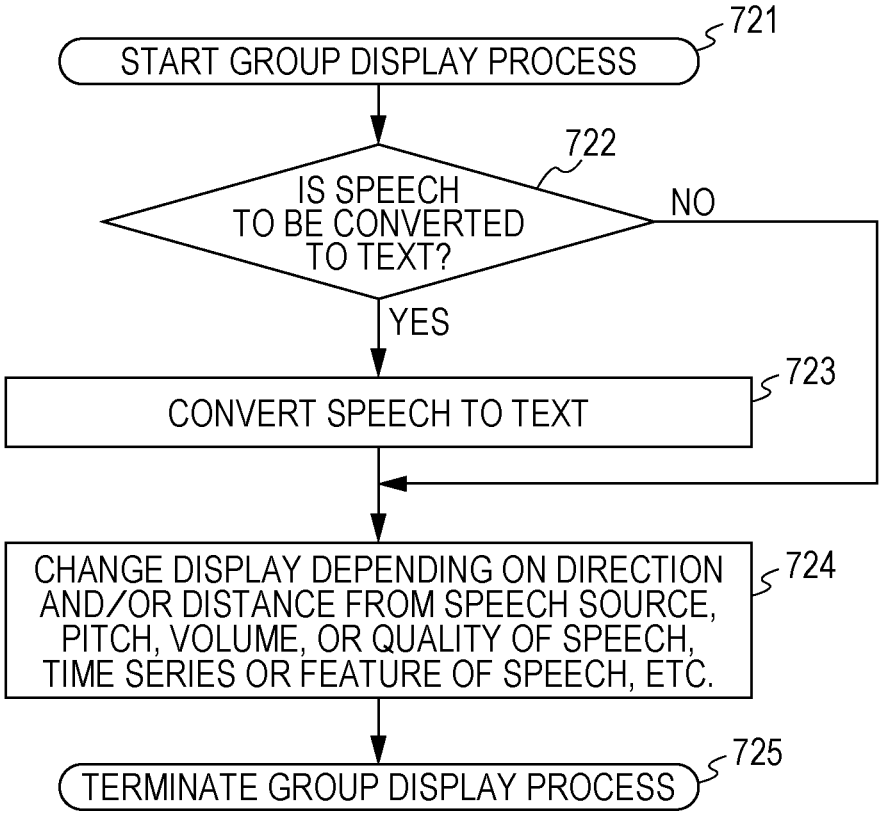
FIG. 7B shows a flowchart for the details of a group display process of the steps in the flowchart shown in FIG. 7A.

FIG. 7B shows a flowchart for the details of steps 705 and 710 (group display process) of the flowchart shown in FIG. 7A. As shown in FIG. 7B, in step 721, the electronic system 101 starts the group display process. In step 722, the electronic system 101 determines whether to convert speech to text. If the speech is to be converted to text, the electronic system 101 advances the process to step 723. If the speech is not to be converted to text, the electronic system 101 advances the process to step 724.

In step 724, in response to the speech needing to be converted to text, the electronic system 101 can display text corresponding to the speech in chronological order in the individual groups on the screen (see FIGS. 2A and 5A). Furthermore, the electronic system 101 can optionally dynamically change the display of the text depending on the directions and/or distances of the speech sources, the pitches, volumes, or qualities of the sounds, the time series or the features of the speech.

In step 724, in response to the speech not needing to be converted to text, the electronic system 101 can display icons indicating the individual groups on the screen (see FIG. 4A). Furthermore, the electronic system 101 can optionally dynamically change the display of the icons indicating the individual groups depending on the directions and/or distances of the speech sources, the pitches, volumes, or qualities of the sounds, the time series or the features of the speech. In step 725, the electronic system 101 terminates the group display process.

Figure 7C:
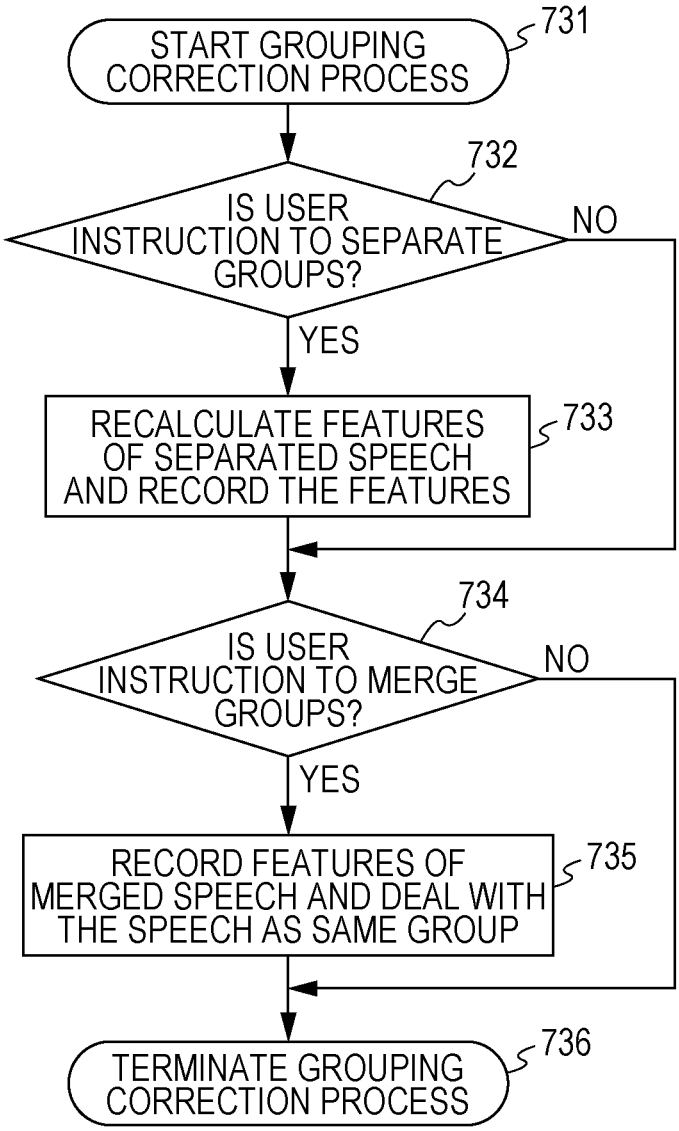
FIG. 7C is a flowchart for the details of a grouping correction process of the steps in the flowchart shown in FIG. 7A.

FIG. 7C is a flowchart for the details of step 707 (grouping correction process) of the flowchart shown in FIG. 7A. As shown in FIG. 7C, in step 731, the electronic system 101 starts the speech-grouping correction process. In step 732, the electronic system 101 determines whether the user instruction received in step 706 is a group separation operation. If the user instruction is a group separation operation, the electronic system 101 advances the process to step 733. If the user instruction is not a group separation operation, the electronic system 101 advances the process to step 734.

In step 733, in response to the user instruction being a group separation operation, the electronic system 101 can recalculate the features of the speech of the separated groups and can record the recalculated features in the main memory 103 or the disk 108 in the electronic system 101. The recalculated features are used for the following grouping. In accordance with the separation process, the electronic system 101 can display the groups on the screen again in step 710 on the basis of the separated groups. In other words, the electronic system 101 can correctly separate a group that is regarded as a single group by mistake into two groups and can display them.

In step 734, the electronic system 101 determines whether the user instruction received in step 708 or the user instruction received in step 706 is an operation of merging at least two groups. If the user instruction is a merging operation, the electronic system 101 advances the process to step 735. If the user instruction is not a merging operation, the electronic system 101 advances the process to step 736 which is a grouping-correction-process termination step.

In step 735, in response to the user instruction being a merging operation, the electronic system 101 merges at least two groups identified by the user. In the following steps, the electronic system 101 deals with speech having the features of the merged groups as a single group. In other words, the electronic system 101 deals with speech having the individual features of the two groups as belonging to the merged single group. Alternatively, the electronic system 101 can extract features common to the at least two merged groups and can record the extracted common features in the main memory 103 or the disk 108 in the electronic system 101. The extracted common features can be used for the subsequent grouping. In step 736, the electronic system 101 terminates the speech-grouping correction process and advances the process to step 708 shown in FIG. 7A.

Figure 7D:
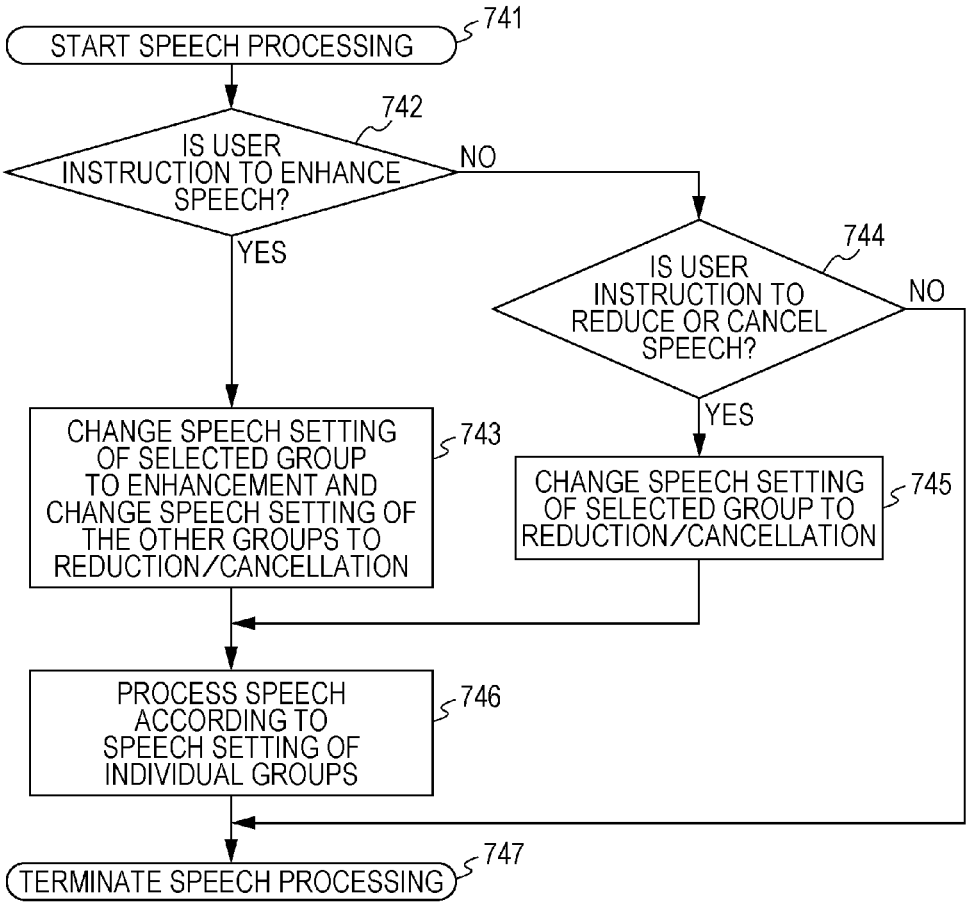
FIG. 7D is a flowchart for the details of a speech processing operation of the steps in the flowchart shown in FIG. 7A.

FIG. 7D is a flowchart for the details of step 709 (speech processing) of the flowchart shown in FIG. 7A. As shown in FIG. 7D, in step 741, the electronic system 101 starts the speech processing operation. In step 742, the electronic system 101 determines whether the user instruction is to enhance the speech in the selected group. If the user instruction is to enhance the speech, the electronic system 101 advances the process to step 743. If the user instruction is not to enhance the speech, the electronic system 101 advances the process to step 744.

In step 743, in response to the user instruction being enhancement, the electronic system 101 changes the speech setting for the selected group to enhancement. The electronic system 101 can store the changed speech setting (enhancement) in, for example, speech-sequence-selection storage means 813 shown in FIG. 8. The electronic system 101 can optionally change the speech settings for all the groups other than the selected group to reduction or cancellation. The electronic system 101 can store the changed speech setting (reduction or cancellation) in, for example, the speech-sequence-selection storage means 813 shown in FIG. 8.

In step 744, the electronic system 101 determines whether the user instruction is to reduce or cancel the speech in the selected group. If the user instruction is to reduce or cancel the speech, the electronic system 101 advances the process to step 745. If the user instruction is not to reduce or cancel the speech, the electronic system 101 advances the process to step 747.

In step 745, in response to the user instruction being to reduce or cancel the speech, the electronic system 101 changes the speech setting for the selected group to reduction/cancellation. The electronic system 101 can store the changed speech setting (reduction or cancellation) in, for example, the speech-sequence-selection storage means 813 shown in FIG. 8.

In step 746, the electronic system 101 processes the speech of the speakers associated with the individual groups in accordance with the speech settings for the individual groups. Specifically, if the speech setting for the target group is enhancement, the electronic system 101 acquires the speech of the speaker associated with the group from, for example, the speech-sequence storage means (see FIG. 8), and enhances the acquired speech; if the speech setting for the target group is reduction or cancellation, the electronic system 101 acquires the speech of the speaker associated with the group from, for example, the speech-sequence storage means (see FIG. 8), and reduces or cancels the acquired speech. The processed speech is output from the speech-signal output means 810 of the electronic system 101, such as a headphone, an earphone, a hearing aid, or a loudspeaker. In step 747, the electronic system 101 terminates the speech processing operation.

Figure 8:
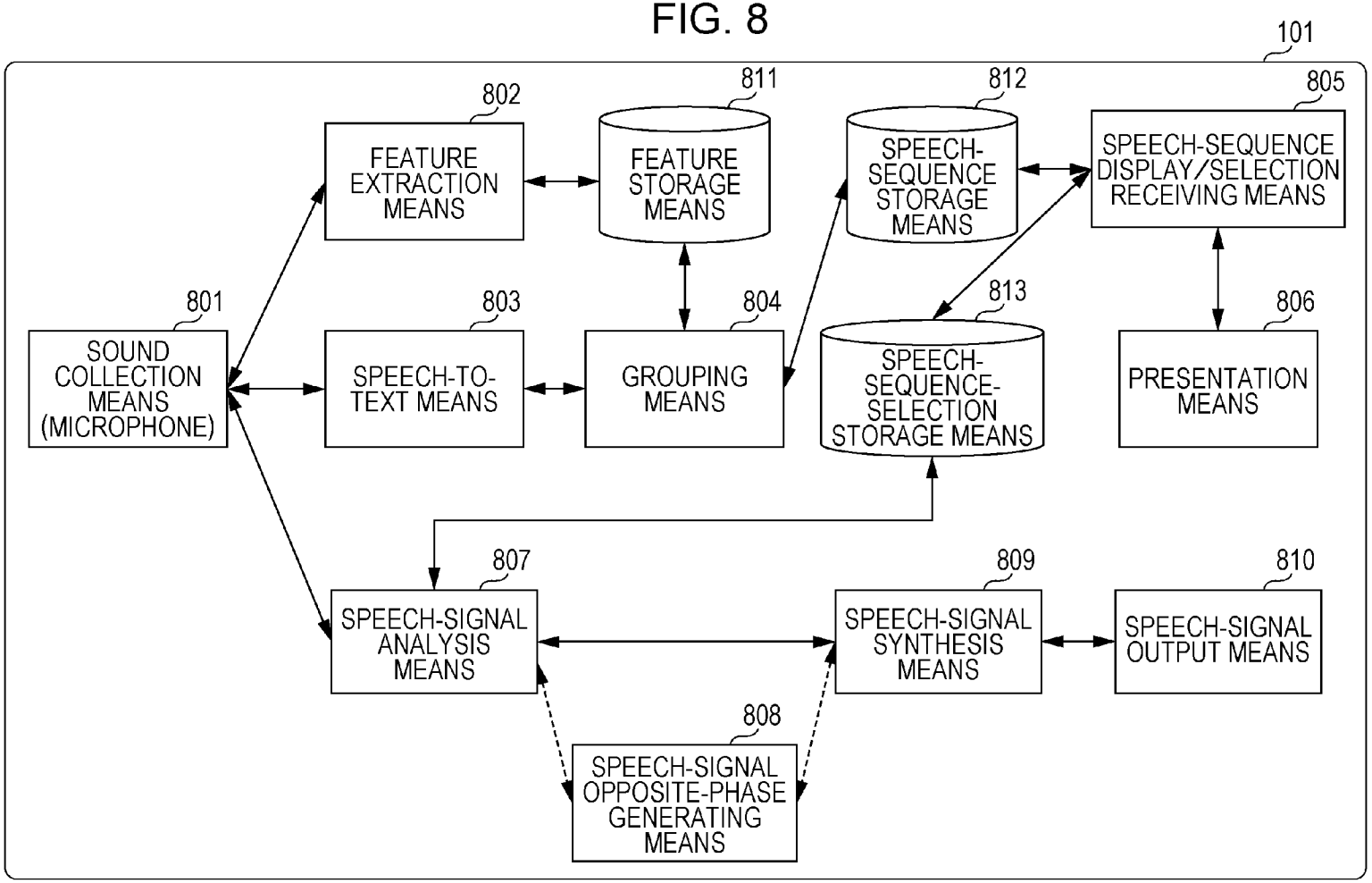
FIG. 8 is a diagram of an example of a functional block diagram of an electronic system that preferably has the hardware configuration shown in FIG. 1 to process the speech of a particular speaker according to an embodiment of the present invention.

FIG. 8 is a diagram of an example of a functional block diagram of the electronic system 101 that preferably has the hardware configuration shown in FIG. 1 to process the speech of a particular speaker according to an embodiment of the present invention. The electronic system 101 can be equipped with a sound collection mechanism 801, feature extraction mechanism 802, speech-to-text mechanism 803, grouping mechanism 804, speech-sequence display/selection receiving mechanism 805, presentation mechanism 806, speech-signal analysis mechanism 807, speech-signal opposite-phase generating mechanism 808, speech-signal synthesis mechanism 809, and the speech-signal output mechanism 810. The electronic system 101 may include the mechanisms 801 to 810 in a single electronic unit or may include the mechanisms 801 to 810 distributed in a plurality of electronic units. How to distribute the mechanisms can be determined depending on the throughputs of the electronic units.

The electronic system 101 can further include feature storage mechanism 811, the speech-sequence storage mechanism 812, and speech-sequence-selection storage mechanism 813. The main memory 103 or the disk 108 of the electronic system 101 can include the functions of the mechanisms 811 to 813. The electronic system 101 may include the mechanisms 811 to 813 in a single electronic unit or may include the mechanisms 811 to 813 distributed in memories or storage means of a plurality of electronic units. Which mechanism is distributed to which electronic unit or memory/storage unit can be determined by those skilled in the art as appropriate depending on, for example, the sizes of data stored in the individual mechanisms 811 to 813 or the order of priority in which the data is extracted.

The sound collection mechanism 801 collects sounds. The sound collection mechanism 801 can execute step 602 in FIG. 6A and step 702 in FIG. 7A (collection of sounds). An example of the sound collection mechanism 801 can be a microphone, for example a directional microphone, embedded in the electronic system 101 or connected to the electronic system 101 by wire or wirelessly. If the directional microphone is used, the electronic system 101 can specify a direction from which the speech is transmitted (the direction of the speech source) by continuously switching the direction in which speech is collected.

The sound collection mechanism 801 may include specification mechanism (not shown) for specifying the direction of the speech source or the direction and distance of the speech source. Alternatively, the specification mechanism may be provided in the electronic system 101.

The feature extraction mechanism 802 analyzes speech collected by the sound collection mechanism 801 and extracts the features of the speech. The feature extraction mechanism 802 can extract the features of the collected speech in step 603 of FIG. 6A and step 703 of FIG. 7A. The feature extraction mechanism 802 can implement a speaker verification engine that is known to those skilled in the art. The feature extraction mechanism 802 can execute the recalculation of the features of the speech of the separated groups in step 613 of FIG. 6B and step 733 of FIG. 7C and the extraction of common features of the features of the individual merged groups in step 615 of FIG. 6B and step 735 of FIG. 7C.

The speech-to-text mechanism 803 converts the speech extracted by the feature extraction mechanism 802 to text. The speech-to-text mechanism 803 can execute step 632 of FIG. 6D and step 722 of FIG. 7B (the process of determining whether to convert speech to text) and step 633 of FIG. 6D and step 723 of FIG. 7B (speech-to-text process). The speech-to-text mechanism 803 can implement a speech-to-text engine that is known to those skilled in the art. The speech-to-text mechanism 803 can implement, for example, two functions, "sound analysis" and "recognition decoder". The "sound analysis" allows the speech of a speaker to be converted to compact data, and "recognition decoder" can analyze the data and convert the data to text. An example of the speech-to-text mechanism 803 includes a speech recognition engine installed in AmiVoice®.

The grouping mechanism 804 groups text corresponding to speech extracted by the feature extraction mechanism 802 on the basis of the features of the speech or groups the speech. The grouping mechanism 804 can group the text acquired from the speech-to-text mechanism 803. The grouping mechanism 804 can execute the grouping in step 603 and the grouping correction process in step 604 of FIG. 6A, step 704 in FIG. 7A (speech grouping), step 732 (determination whether the user instruction is separation) and step 734 (determination whether the user instruction is merging) in FIG. 7C. Furthermore, the grouping mechanism 804 can execute step 613 in FIG. 6B and step 733 in FIG. 7C (recording of the recalculated features of the speech of the separated groups) and step 615 in FIG. 6B and step 735 in FIG. 7C (recording of common features of the features of the individual merged groups).

The speech-sequence display/selection receiving mechanism 805 can execute step 634 in FIG. 6D and step 724 in FIG. 7B (display of text in the groups). The speech-sequence display/selection receiving mechanism 805 receives speech settings for the individual groups in step 623, step 625, and step 627 of FIG. 6C and steps 743 and step 745 in FIG. 7D. The speech-sequence display/selection receiving mechanism 805 can store the speech settings set for the individual groups in the speech-sequence-selection storage mechanism 813.

The presentation mechanism 806 presents the results of grouping by the grouping mechanism 804 to the user. The presentation mechanism 806 can display the text acquired from the speech-to-text mechanism 803 in accordance with the grouping by the grouping mechanism 804. The presentation mechanism 806 can display the text acquired from the speech-to-text mechanism 803 in chronological order. The presentation mechanism 806 can display the text grouped by the grouping mechanism 804 and thereafter display text corresponding to the subsequent speech of the speaker associated with the group. The presentation mechanism 806 can display the text grouped by the grouping mechanism 804 at positions close to the specified directions on the presentation mechanism 806 or predetermined positions on the presentation mechanism 806 corresponding to the specified directions and distances. The presentation mechanism 806 can change the display positions of the text grouped by the grouping mechanism 804 in response to the movement of the speakers. The presentation mechanism 806 can change the display method for the text acquired from the speech-to-text mechanism 803 depending on the volumes or pitches, or qualities of the speech or the features of the speech of speakers associated with the groups by the grouping mechanism 804. Furthermore, the groups grouped by the grouping mechanism 804 can be displayed in different colors depending on the volumes, pitches, or qualities of the speech or the features of the speech of speakers associated with the groups. An example of the presentation mechanism 806 includes the display 106. The presentation mechanism 806 can display the text in the individual groups on the screen in chronological order or can display icons indicating the individual groups on the screen in step 634 of FIG. 6D and step 724 of FIG. 7B.

The speech-signal analysis mechanism 807 analyzes the speech data from the sound collection mechanism 801. The analyzed data can be used to generate sound waves opposite in phase to the speech in the speech-signal opposite-phase generating mechanism 808 or to generate synthesis speech in which the speech is enhanced or synthesis speech in which the speech is reduced or cancelled by the speech-signal synthesis mechanism 809.

The speech-signal opposite-phase generating mechanism 808 can execute the speech processing operations in step 628 of FIG. 6C and step 746 of FIG. 7D. The speech-signal opposite-phase generating mechanism 808 can generate sound waves opposite in phase to the speech to be reduced or cancelled by using the speech data from the sound collection mechanism 801.

When one or more groups are selected by the user, the speech-signal synthesis mechanism 809 enhances or reduces/cancels the speech of a speaker associated with the selected group. If the speech of the speaker is to be reduced or cancelled, the speech-signal synthesis mechanism 809 can use sound waves in opposite phase generated by the speech-signal opposite-phase generating mechanism 808. The speech-signal synthesis mechanism 809 combines the data from the speech-signal analysis mechanism 807 and the data generated by the speech-signal opposite-phase generating mechanism 808 to synthesize speech in which the speech of the particular speaker is reduced or cancelled. When the speech of the speaker associated with the selected group is enhanced, and thereafter the selected group is selected again by the user, the speech-signal synthesis mechanism 809 can reduce or cancel the speech of the speaker associated with the selected group. When the speech of the speaker associated with the selected group is reduced or cancelled, and thereafter the selected group is selected again by the user, the speech-signal synthesis mechanism 809 can enhance the speech of the speaker associated with the selected group.

The speech-signal output mechanism 810 can include a headphone, an earphone, a hearing aid, and a loudspeaker. The electronic system 101 can be connected to the speech-signal output mechanism 810 by wire or wirelessly (for example, Bluetooth®). The speech-signal output mechanism 810 outputs synthesized speech generated by the speech-signal synthesis mechanism 809 (speech in which the speech of the speaker is enhanced or speech in which the speech of the speaker is reduced or cancelled). The speech-signal output mechanism 810 can output digitized speech collected by the sound collection mechanism 801 as it is.

The feature storage mechanism 811 stores the features of speech extracted by the feature extraction mechanism 802.

The speech-sequence storage mechanism 812 stores text obtained by the speech-to-text mechanism 803. The speech-sequence storage mechanism 812 can store tags or attributes that allow the presentation mechanism 806 to display text in chronological order together with the text.

The speech-sequence-selection storage mechanism 813 stores speech settings set for individual groups (that is, reduction/cancellation or enhancement).

What is claimed is:

1. A method, in a data processing system comprising a processor and a memory, for processing the speech of a particular speaker with an electronic system, the method comprising:

collecting, by the data processing system, speech;

converting the collected speech to text;

analyzing, by the data processing system, the speech to extract features of the speech;

grouping, by the data processing system, one of the speech, or text corresponding to the speech, on the basis of the extracted features into one group in a plurality of groups of speakers;

presenting, by the data processing system, results of the grouping to a user via a graphical user interface;

receiving, by the data processing system, a user input, via the graphical user interface, in response to presenting the results of the grouping to the user, user input specifying one of a user request to enhance, reduce, or cancel speech of a selected speaker associated with a selected group; and performing, by the data processing system, an operation in accordance with the user input to enhance, reduce, or cancel the speech of the selected speaker associated with the selected group, wherein:

presenting the result of the grouping comprises displaying the text corresponding to the collected speech as associated with a first group and a first speaker in accordance with the grouping on a display to thereby generate grouped text, in response to the user input specifying a request to enhance the speech of the selected speaker, the operation comprises presenting text corresponding to speech associated with other groups in the plurality of groups in a relatively fainter manner in comparison to text corresponding to speech associated with the selected speaker, in the graphical user interface, and in response to the user input specifying a request to reduce or cancel speech of the selected speaker, the operation comprises presenting text corresponding to speech associated with the selected speaker in a relatively fainter manner in comparison to text corresponding to speech associated with other groups in the plurality of groups, in the graphical user interface.

2. The method according to claim 1, wherein reducing or cancelling the speech comprises at least one of:

outputting sound waves in opposite phase to the speech of the speaker associated with the selected group; or reducing or cancelling the speech of the speaker associated with the selected group by reproducing synthesis speech in which the speech of the speaker associated with the selected group is reduced or cancelled.

3. The method according to claim 1, wherein displaying the text further comprises displaying the grouped text in chronological order relative to previously grouped text.

4. The method according to claim 1, wherein displaying the text further comprises displaying text corresponding to subsequent speech of a speaker associated with a group in the plurality of groups, following previously grouped text associated with the group.

5. The method according to claim 1, further comprising specifying a direction of a speech source of the speech, or a direction and distance of the speech source, wherein displaying the text further comprises displaying the grouped text at a position on the display that is approximately at the specified direction, or at a predetermined position on the display corresponding to the specified direction and distance, of the speech source relative to the data processing system.

6. The method according to claim 5, wherein displaying the text further comprises changing a display position of the grouped text as the speech source moves relative to the data processing system, such that the display position of the grouped text maintains at an approximate specified direction of the speech source relative to the data processing system.

7. The method according to claim 1, wherein displaying the text further comprises changing a display method for the grouped text on a basis of the volume, pitch, or quality of the speech, or a feature of the speech of a speaker associated with the group.

8. The method according to claim 1, wherein displaying the text further comprises displaying the groups, in the plurality of groups, in different colors on a basis of the volumes, pitches, or qualities of the speech, or features of speech of speakers associated with the groups.

9. The method according to claim 1, further comprising:

in response to the selected group being selected again by the user after the performing the operation for enhancing, reducing or cancelling the speech of the speaker associated with the selected group; or in response to the selected group being selected again by the user after the performing the operation for reducing or cancelling, enhancing the speech of the speaker associated with the selected group.

10. The method according to claim 1, further comprising:

receiving user input to select part of the grouped text to generate partial text; and separating the partial text, selected by the user, into a separated second group associated with a second speaker different from the first speaker and that is separate from the first group in which the text was grouped.

11. The method according to claim 10, further comprising:

distinguishing a feature of speech of the second speaker associated with the separated second group from a feature of speech of the first speaker associated with the first group.

12. The method according to claim 11, further comprising:

displaying, in the separated second group, text corresponding to the subsequent speech of the second speaker associated with the separated second group in accordance with the feature of the speech of the second speaker associated with the separated second group.

13. The method according to claim 1, further comprising:

permitting the user to select at least two of the groups; and in response to receiving a user input to select the at least two of the groups, combining the at least two groups selected by the user as one group.

14. The method according to claim 13, further comprising:

combining speech of speakers associated with the at least two groups as speech combined as one group; and displaying text corresponding to the speech combined as one group in the combined one group.

15. The method according to claim 1, wherein:

presenting comprises grouping the speech on the basis of the features and displaying the result of the grouping on a display;

the method further comprises specifying a direction of a source of the speech or a direction and distance of the source of the speech; and displaying the result of the grouping on the display comprises displaying an icon indicating the speaker at a position on the display close to the specified direction or a predetermined position on the display corresponding to the specified direction and distance.

16. The method according to claim 15, wherein displaying the result of the grouping further comprises displaying text corresponding to the speech of the speaker in the vicinity of the icon indicating the speaker.

17. A computer program product comprising a non-transitory computer readable medium having a computer readable program stored therein, wherein the computer readable program, when executed on a computing device, causes the computing device to:

collect speech;

convert the collected speech to text;

analyze the speech to extract features of the speech;

group one of the speech or text corresponding to the speech on the basis of the extracted features into one group in a plurality of groups of speakers;

present results of the grouping to a user via a graphical user interface;

receive a user input, via the graphical user interface, in response to presenting the results of the grouping to the user, the user input specifying one of a user request to enhance, reduce, or cancel speech of a selected speaker associated with a selected group; and perform an operation in accordance with the user input to enhance, reduce, or cancel the speech of the selected speaker associated with the selected group, wherein:

presenting the result of the grouping comprises displaying the text corresponding to the collected speech as associated with a first group and a first speaker in accordance with the grouping on a display to thereby generate grouped text, in response to the user input specifying a request to enhance the speech of the selected speaker, the operation comprises presenting text corresponding to speech associated with other groups in the plurality of groups in a relatively fainter manner in comparison to text corresponding to speech associated with the selected speaker, in the graphical user interface, and in response to the user input specifying a request to reduce or cancel speech of the selected speaker, the operation comprises presenting text corresponding to speech associated with the selected speaker in a relatively fainter manner in comparison to text corresponding to speech associated with other groups in the plurality of groups, in the graphical user interface.

18. An electronic system for processing the speech of a particular speaker, comprising:

a sound collection mechanism that collects speech;

a feature extraction mechanism that analyzes the speech to extract the features of the speech;

a grouping mechanism that groups speech, or text corresponding to the speech, on the basis of the extracted features into one group in a plurality of groups of speakers;

a presentation mechanism that presents results of the grouping to a user via a graphical user interface;

a speech-to-text mechanism that converts the speech to text; and a speech-signal synthesis mechanism that receives a user input, via the graphical user interface, in response to presenting the results of the grouping to the user, the user input specifying one of a user request to enhance, reduce, or cancel speech of a selected speaker associated with a selected group, and performs an operation in accordance with the user input to enhance, reduce, or cancel the speech of the selected speaker associated with the selected group, wherein:

the presentation mechanism displays text corresponding to the speech in accordance with the grouping, in response to the user input specifying a request to enhance the speech of the selected speaker, the operation comprises presenting text corresponding to speech associated with other groups in the plurality of groups in a relatively fainter manner in comparison to text corresponding to speech associated with the selected speaker, in the graphical user interface, and in response to the user input specifying a request to reduce or cancel speech of the selected speaker, the operation comprises presenting text corresponding to speech associated with the selected speaker in a relatively fainter manner in comparison to text corresponding to speech associated with other groups in the plurality of groups, in the graphical user interface.

* * * * *